US010503088B2

(12) United States Patent
Fuchigami et al.

(10) Patent No.: US 10,503,088 B2
(45) Date of Patent: Dec. 10, 2019

(54) ELECTROPHOTOGRAPHIC PHOTORECEPTOR, IMAGE FORMING APPARATUS, AND COATING LIQUID FOR FORMING PHOTOSENSITIVE LAYER

(71) Applicant: Mitsubishi Chemical Corporation, Chiyoda-ku (JP)

(72) Inventors: Hiroe Fuchigami, Kanagawa (JP); Mitsuo Wada, Kanagawa (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 16/210,378

(22) Filed: Dec. 5, 2018

(65) Prior Publication Data

US 2019/0107790 A1 Apr. 11, 2019

Related U.S. Application Data

(60) Division of application No. 15/591,692, filed on May 10, 2017, now Pat. No. 10,197,928, which is a (Continued)

(30) Foreign Application Priority Data

Nov. 10, 2014 (JP) ..... 2014-228030
Jul. 10, 2015 (JP) ..... 2015-138952

(51) Int. Cl.
*G03G 5/00* (2006.01)
*G03G 5/047* (2006.01)
(Continued)

(52) U.S. Cl.
CPC ..... *G03G 5/047* (2013.01); *G03G 5/0507* (2013.01); *G03G 5/0521* (2013.01);
(Continued)

(58) Field of Classification Search
CPC ..... G03G 5/0542; G03G 5/0696
(Continued)

(56) References Cited

U.S. PATENT DOCUMENTS 5,153,088 A 10/1992 Muto et al.
6,027,844 A 2/2000 Nguyen et al.
(Continued)

FOREIGN PATENT DOCUMENTS

JP 2-228670 A 9/1990
JP 8-36270 A 2/1996
(Continued)

OTHER PUBLICATIONS

Office Action dated Feb. 19, 2019 in the corresponding Japanese Patent Application No. 2015-138952 with Unedited Computer-Generated English Translation.
(Continued)

*Primary Examiner* — Mark A Chapman
(74) *Attorney, Agent, or Firm* — Oblon, McClelland, Maier & Neustadt, L.L.P.

(57) ABSTRACT

The present invention relates to an electrophotographic photoreceptor which is a positive charging type electrophotographic photoreceptor comprising a conductive support and a photosensitive layer on the conductive support, wherein the photosensitive layer contains at least a charge generating material, a hole transport material, an electron transport material, and a binder resin in the same layer, and a residual potential $VL_1$ at a point at which an exposure amount for forming a latent image is 0.3 μJ/cm$^2$ is equal to or lower than 130 V when an initial surface potential V0 is set to +700 V, exposure with monochromatic light of 780 nm is performed and measurement is performed by a dynamic method.

14 Claims, 2 Drawing Sheets

Related U.S. Application Data continuation of application No. PCT/JP2015/081558, filed on Nov. 10, 2015.

(51) Int. Cl.

| | |
|---|---|
| ***G03G 5/05*** | (2006.01) |
| ***G03G 5/06*** | (2006.01) |
| ***G03G 5/10*** | (2006.01) |
| ***G03G 5/14*** | (2006.01) |
| ***G03G 15/00*** | (2006.01) |

(52) U.S. Cl.

CPC ..... *G03G 5/0525* (2013.01); *G03G 5/0542* (2013.01); *G03G 5/0564* (2013.01); *G03G 5/069* (2013.01); *G03G 5/0609* (2013.01); *G03G 5/0614* (2013.01); *G03G 5/0696* (2013.01); *G03G 5/102* (2013.01); *G03G 5/142* (2013.01); *G03G 15/75* (2013.01)

(58) Field of Classification Search

USPC ..... 430/59.5

See application file for complete search history.

(56) References Cited

U.S. PATENT DOCUMENTS

| | | | | |
|---|---|---|---|---|
| 6,335,132 | B1 * | 1/2002 | Tanaka | G03G 5/0517 399/111 |
| 6,514,651 | B1 * | 2/2003 | Hayata | C09B 47/064 430/135 |
| 10,197,928 | B2 * | 2/2019 | Fuchigami | G03G 5/047 |
| 2004/0126140 | A1 | 7/2004 | Azuma et al. | |
| 2008/0044750 | A1 * | 2/2008 | Abe | G03G 5/051 430/69 |
| 2009/0232551 | A1 | 9/2009 | Nagao et al. | |
| 2013/0288170 | A1 | 10/2013 | Saito et al. | |
| 2014/0212803 | A1 | 7/2014 | Iwashita et al. | |
| 2014/0356773 | A1 | 12/2014 | Azuma et al. | |
| 2015/0212436 | A1 | 7/2015 | Fuji1 et al. | |

FOREIGN PATENT DOCUMENTS

| | | | |
|---|---|---|---|
| JP | 2003-280233 | A | 10/2003 |
| JP | 2003-280252 | A | 10/2003 |
| JP | 2004-45991 | A | 2/2004 |
| JP | 3748452 | B2 | 2/2006 |
| JP | 2010-151968 | A | 7/2010 |
| JP | 2013-231866 | A | 11/2013 |
| JP | 2014-81621 | A | 5/2014 |
| JP | 2014-130236 | A | 7/2014 |
| JP | 2014-146005 | A | 8/2014 |
| JP | 2014-235251 | A | 12/2014 |
| WO | WO 2007/078006 | A1 | 7/2007 |

OTHER PUBLICATIONS

Office Action dated Feb. 19, 2019 in the corresponding Japanese Patent Application No. 2015-219628 with Unedited Computer-Generated English Translation.

International Search Report dated Jan. 26, 2016 in PCT/JP2015/081558 (with English translation).

Decision of Refusal dated Aug. 20, 2019 issued in corresponding Japanese patent application 2015-138952, (with machine translation).

Decision of Refusal dated Aug. 20, 2019 issued in corresponding Japanese patent application 2015-219628 (with machine translation).

* cited by examiner

[Fig. 1]
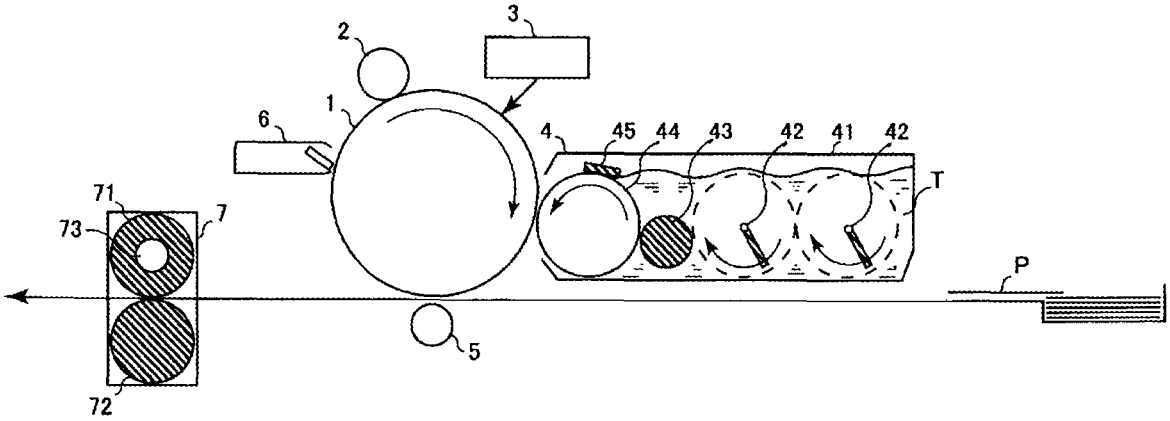
[Fig. 2]
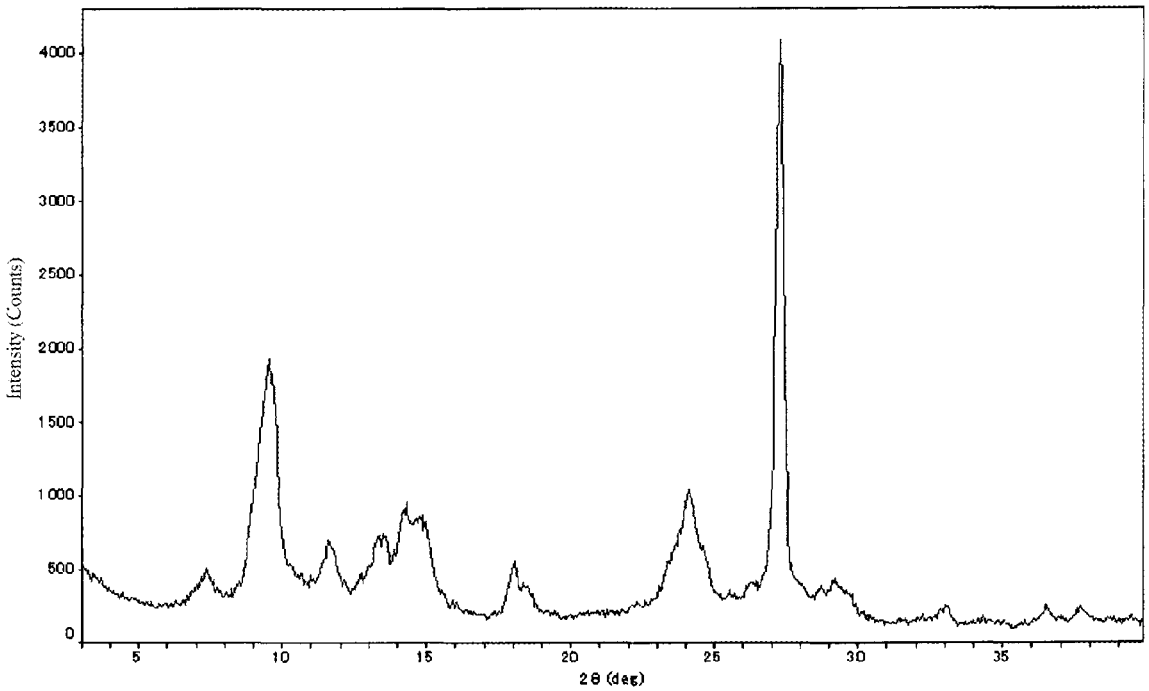

[Fig. 3]
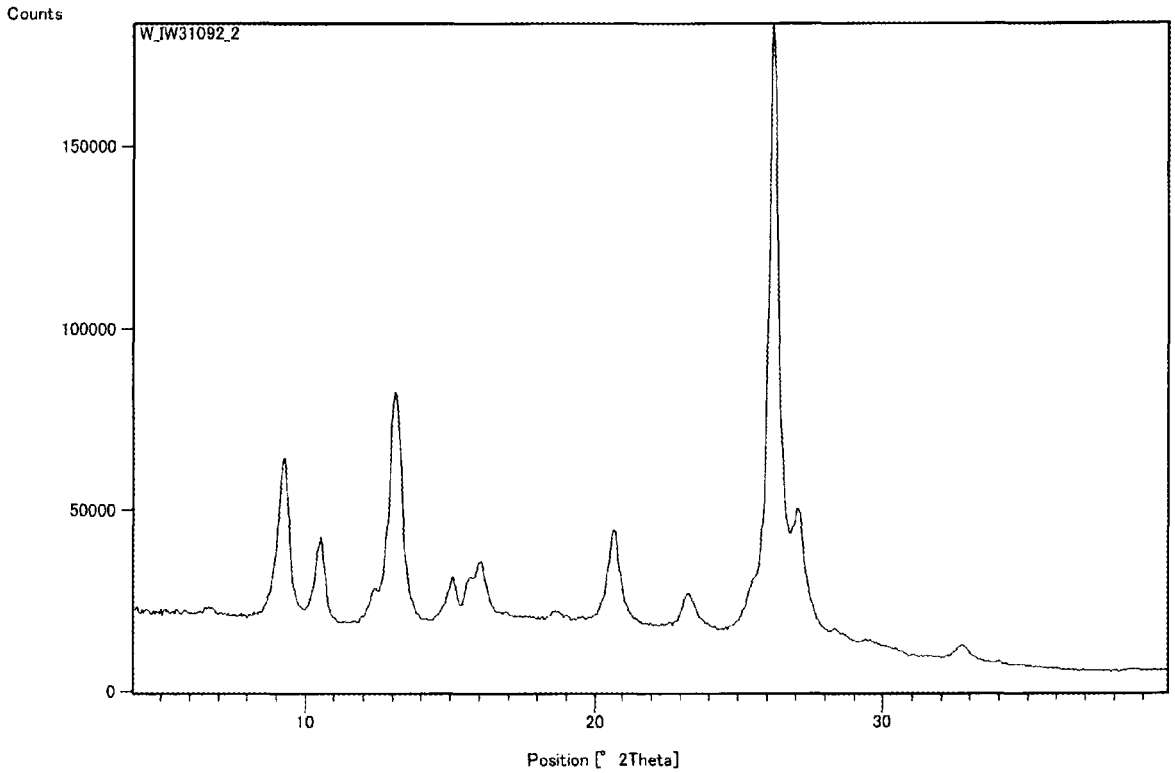
[Fig. 4]
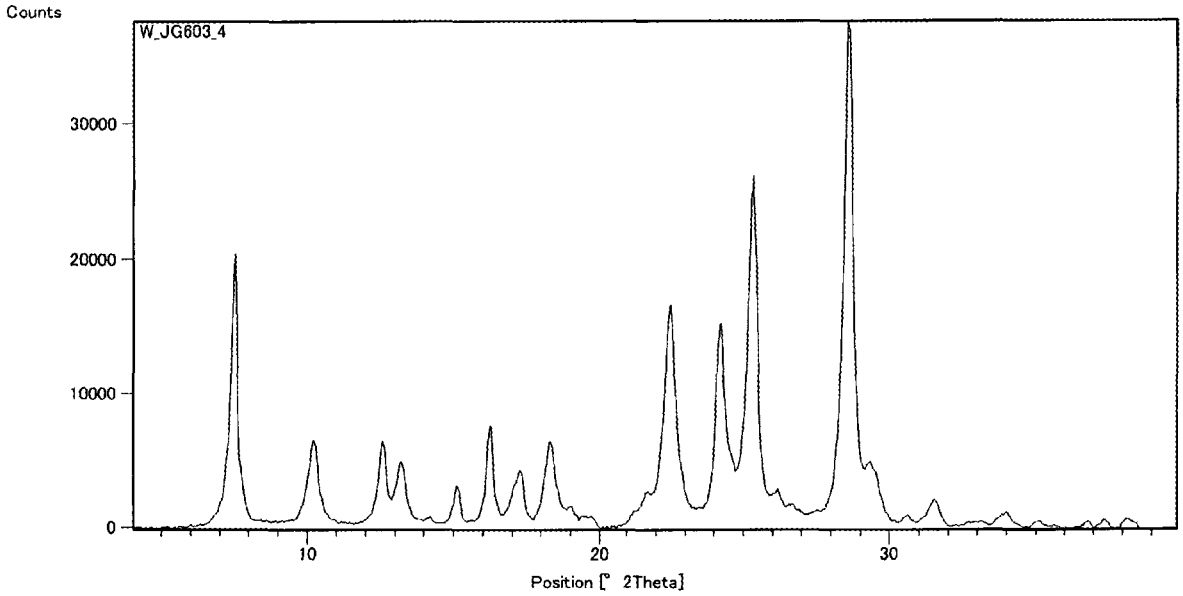

ELECTROPHOTOGRAPHIC PHOTORECEPTOR, IMAGE FORMING APPARATUS, AND COATING LIQUID FOR FORMING PHOTOSENSITIVE LAYER

CROSS REFERENCE TO RELATED APPLICATIONS

The present application is a divisional of U.S. application Ser. No. 15/591,692, filed on May 10, 2017, which is a continuation of International patent application PCT/JP2015/081558, filed on Nov. 10, 2015, and claims the benefit of the filing date of Japanese application nos. 2014-228030, filed on Nov. 10, 2014, and 2015-138952, filed on Jul. 10, 2015, the text of each of which is incorporated by reference.

TECHNICAL FIELD

The present invention relates to an electrophotographic photoreceptor and an image forming apparatus used in a copier, a printer, and the like. In detail, the present invention relates to a single-layer type electrophotographic photoreceptor which has good electrical characteristics and has excellent stability of a coating liquid for forming a photosensitive layer, and relates to an image forming apparatus which includes the photoreceptor.

BACKGROUND ART

An electrophotographic technology is widely used in the fields of a copier, various printers, and the like because an image having immediacy and high quality is obtained, for example. Regarding an electrophotographic photoreceptor (simply also referred to as "a photoreceptor" below) as the core of the electrophotographic technology, a photoreceptor which uses an organic photoconductive substance is used. The organic photoconductive substance has an advantage, for example, that forming a film without pollution is easily performed, and manufacturing is easily performed.

In an organic electrophotographic photoreceptor, in a case of a so-called function-separation type photoreceptor in which functions of generation and moving of charges are divided up to compounds which are separate from each other, a range of materials to be selectable is wide and characteristics of the photoreceptor are easily controlled. Thus, the function-separation type photoreceptor becomes the mainstream in development. From a viewpoint of a layer configuration, a single-layer type electrophotographic photoreceptor (referred to as a single-layer type photoreceptor below) and a laminate type electrophotographic photoreceptor (referred to as a laminate type photoreceptor below) are known. In the single-layer type photoreceptor, a charge generating material and a charge transport material are contained in the same layer. In the laminate type photoreceptor, the charge generating material and the charge transport material are respectively contained in layers (charge generation layer and charge transport layer) and the layers are stacked on each other.

In a case of the laminate type photoreceptor, on the design of the photoreceptor, optimization of a function for each layer is easily achieved, and control of characteristics is also easily performed. Thus, most of the current photoreceptor has this type. In many of such a laminate type photoreceptor, a charge generation layer and a charge transport layer are stacked on a conductive support in this order. Regarding the charge transport layer, the number of suitable electron transport materials is very small, but many material having good characteristics are known as a hole transport material. Thus, a negative charging method is employed in a laminate type photoreceptor using such a hole transport material. The hole transport material is improved with high speed and high image quality of the recent printer, copier, and the like, and thus it is realized in the negative charging method, that a residual potential is significantly reduced (PTL 1).

Contrarily, all of the negative charging method and a positive charging method can be used in a single-layer type photoreceptor. If the positive charging method is used, it is possible to suppress an occurrence of ozone which is a problem in the laminate type photoreceptor, to be small. Thus, electrical characteristics in the positive-charging single-layer type photoreceptor are worse than those in the negative-charging laminate type photoreceptor, in many cases. However, some of positive-charging single-layer type photoreceptors are commercially used as a positive-charging single-layer type electrophotographic photoreceptor (PTL 2).

Even in a positive-charging type image forming apparatus, size reduction, high sensitivity, and high durability of the apparatus are examined in accordance with the current request. For example, regarding size reduction, the following technology is known (PTL 3). That is, in a single-layer type electrophotographic photoreceptor in which a memory image is not generated even in an image forming apparatus which does not include an erasing process, a photosensitive layer contains a phthalocyanine compound as a charge generating material, a hole transport agent, and an electron transport material, in a binder resin. The specific amount of the phthalocyanine compound is contained. The film thickness of a photosensitive layer is 10 to 35 μm. A difference of an absolute value in sensitivity between a positive polarity and a negative polarity which are measured under a predetermined condition is set to be equal to or less than 500 V (PTL 3).

Regarding high sensitivity, a technology in which a photosensitive layer is provided is disclosed (PTL 4). In the photosensitive layer, the half decay amount at a time of positive charging is equal to or less than 0.18 $\mu J/cm^2$, and the half decay amount at a time of negative charging is twice to 12 times the half decay amount at a time of positive charging. Further, a technology in which a filler is contained in a photosensitive layer is disclosed (PTL 5). The filler is contained in order to reduce an occurrence of friction between a contact charging type charging unit and the surface of a photoreceptor in a case of being used in an image forming apparatus which includes the charging unit. The filler has a volume average particle diameter of 5 nm to 5 μm.

CITATION LIST

Patent Literature

[PTL 1] JP-A-2014-081621
[PTL 2] JP-A-2-228670
[PTL 3] Japanese Patent No. 3748452
[PTL 4] JP-A-2013-231866
[PTL 5] JP-A-2014-130236

SUMMARY OF INVENTION

Technical Problem

There are many cases of requiring a photoreceptor having higher sensitivity with regard to the recent high-performance and high-speed machine under such a background. In particular, a residual potential is reduced to be very small, and thus it is possible to widen design margin for a high-performance and high-speed machine. However, in the positive charging method, using a large amount of the charge generating material is required for reducing the residual potential. In this case, charging properties are deteriorated by properties of the charge generating material, and a dispersion state of the charge generating material in a photosensitive layer becomes worse. Thus, there are problems in that a fog occurs, an appropriate image density is not obtained, and density unevenness occurs.

The photosensitive layer in the positive charging type electrophotographic photoreceptor is needed to contain many materials, for example, a charge generating material, a hole transport material, an electron transport material, and a binder resin. Thus, there are many points which are needed to consider interaction between the materials, coating properties, and the like, and consequently, developing the positive charging type electrophotographic photoreceptor which aims to achieve a low residual potential is very difficult.

The present invention is made to solve the above-described problem. That is, an object of the present invention is to provide a positive-charging single-layer type electrophotographic photoreceptor in which a very low residual potential and high sensitivity can be achieved and an occurrence of density unevenness is suppressed with maintaining charging properties, and to provide an image forming apparatus which includes the photoreceptor and has good image density.

Solution to Problem

The inventors found a photoreceptor which is a positive charging type electrophotographic photoreceptor and can achieve a very low residual potential and high sensitivity, and obtained the present invention. The electrophotographic photoreceptor includes a photosensitive layer in which at least a charge generating material, a hole transport material, an electron transport material, and a binder resin are contained in the same layer, on a conductive support.

That is, the main points of the present invention are included in the following 1. to 27.

1. An electrophotographic photoreceptor which is a positive charging type electrophotographic photoreceptor comprising a conductive support and a photosensitive layer on the conductive support, wherein the photosensitive layer contains at least a charge generating material, a hole transport material, an electron transport material, and a binder resin in the same layer, and a residual potential $VL_1$ at a point at which an exposure amount for forming a latent image is 0.3 $\mu J/cm^2$ is equal to or lower than 130 V when an initial surface potential V0 is set to +700 V, exposure with monochromatic light of 780 nm is performed and measurement is performed by a dynamic method.

2. The electrophotographic photoreceptor according to the 1 above, wherein the residual potential $VL_1$ is equal to or lower than 110 V.

3. An electrophotographic photoreceptor which is a positive charging type electrophotographic photoreceptor comprising a conductive support and a photosensitive layer on the conductive support, wherein the photosensitive layer contains at least a charge generating material, a hole transport material, an electron transport material, and a binder resin in the same layer, and a residual potential $VL_2$ at a point at which an exposure amount for forming a latent image is 0.5 $\mu J/cm^2$ is equal to or lower than 100 V when an initial surface potential V0 is set to +700 V, exposure with monochromatic light of 780 nm is performed and measurement is performed by a dynamic method.

4. The electrophotographic photoreceptor according to the 3 above, wherein the residual potential $VL_2$ is equal to or lower than 80 V.

5. An electrophotographic photoreceptor which is a positive charging type electrophotographic photoreceptor comprising a conductive support and a photosensitive layer on the conductive support, wherein the photosensitive layer contains at least a charge generating material, a hole transport material, an electron transport material, and a binder resin in the same layer, and a residual potential $VL_3$ at a point at which an exposure amount for forming a latent image is 0.8 $\mu J/cm^2$ is equal to or lower than 90 V when an initial surface potential V0 is set to +700 V, exposure with monochromatic light of 780 nm is performed and measurement is performed by a dynamic method.

6. The electrophotographic photoreceptor according to the 5 above, wherein the residual potential $VL_3$ is equal to or lower than 70 V.

7. An electrophotographic photoreceptor which is a positive charging type electrophotographic photoreceptor comprising a conductive support and a photosensitive layer on the conductive support, wherein the photosensitive layer contains at least a charge generating material, a hole transport material, an electron transport material, and a binder resin in the same layer, and a residual potential $VL_4$ at a point at which an exposure amount for forming a latent image is 1.0 $\mu J/cm^2$ is equal to or lower than 80 V when an initial surface potential V0 is set to +700 V, exposure with monochromatic light of 780 nm is performed and measurement is performed by a dynamic method.

8. The electrophotographic photoreceptor according to the 7 above, wherein the residual potential $VL_4$ is equal to or lower than 70 V.

9. An electrophotographic photoreceptor which is a positive charging type electrophotographic photoreceptor comprising a conductive support and a photosensitive layer on the conductive support, wherein the photosensitive layer contains at least a charge generating material, a hole transport material, an electron transport material, and a binder resin in the same layer, and a residual potential $VL_5$ at a point at which an exposure amount for forming a latent image is 1.5 $\mu J/cm^2$ is equal to or lower than 70 V when an initial surface potential V0 is set to +700 V, exposure with monochromatic light of 780 nm is performed and measurement is performed by a dynamic method.

10. An electrophotographic photoreceptor which is a positive charging type electrophotographic photoreceptor comprising a conductive support and a photosensitive layer on the conductive support, wherein the photosensitive layer contains at least a charge generating material, a hole transport material, an electron transport material, and a binder resin in the same layer, and when an initial surface potential V0 is set to +700 V, exposure with monochromatic light of 780 nm is performed and measurement is performed by a dynamic method, a residual potential $VL_1$ at a point at which an exposure amount for forming a latent image is 0.3 $\mu J/cm^2$ is equal to or lower than 130 V, a residual potential $VL_2$ at a point at which an exposure amount for forming a latent image is 0.5 $\mu J/cm^2$ is equal to or lower than 100 V, a residual potential $VL_3$ at a point at which an exposure amount for forming a latent image is 0.8 $\mu J/cm^2$ is equal to or lower than 90 V, a residual potential $VL_4$ at a point at which an exposure amount for forming a latent image is 1.0 $\mu J/cm^2$ is equal to or lower than 80 V, and a residual potential $VL_5$ at a point at which an exposure amount for forming a latent image is 1.5 μJ/cm$^2$ is equal to or lower than 70 V.

11. The electrophotographic photoreceptor according to the 10 above, wherein the residual potential $VL_1$ is equal to or lower than 110 V, the residual potential $VL_2$ is equal to or lower than 80 V, the residual potential $VL_3$ is equal to or lower than 70 V, and the residual potential $VL_4$ is equal to or lower than 70 V.

12. The electrophotographic photoreceptor according to any one of the 1 to 11 above, which comprises, on the conductive support, a photosensitive layer containing at least a charge generating material, a hole transport material, an electron transport material, a filler, and a binder resin in the same layer.

13. The electrophotographic photoreceptor according to the 12 above, wherein the filler is silica.

14. The electrophotographic photoreceptor according to the 12 or 13 above, wherein an average primary particle diameter of the filler is smaller than an average primary particle diameter of the charge generating material.

15. The electrophotographic photoreceptor according to any one of the 1 to 14 above, which comprises a photosensitive layer containing a polycarbonate resin and a polyvinyl acetal resin in the same layer.

16. The electrophotographic photoreceptor according to any one of the 1 to 15 above, wherein the charge generating material is titanyl phthalocyanine.

17. The electrophotographic photoreceptor according to the 16 above, wherein the titanyl phthalocyanine has a main clear peak at a Bragg angle 2θ±0.2° of 27.2° in powder X-ray diffraction using a CuKα characteristic X-ray.

18. The electrophotographic photoreceptor according to any one of the 1 to 17 above, wherein an energy level E_homo of HOMO obtained as a result of structural optimization calculation by density functional calculation B3LYP/6-31G (d, p) of the hole transport material satisfies the following expression.

$$E_homo > -4.65 \text{ (eV)}$$

19. The electrophotographic photoreceptor according to any one of the 1 to 18 above, which comprises an undercoat layer between the conductive support and the photosensitive layer.

20. An image forming apparatus comprising the electrophotographic photoreceptor according to any one of the 1 to 19 above.

21. An electrophotographic photoreceptor which is a positive charging type electrophotographic photoreceptor comprising a conductive support and a single-layer type photosensitive layer on the conductive support, wherein the single-layer type photosensitive layer contains at least a charge generating material, a hole transport material, an electron transport material, and a binder resin in the same layer, and the single-layer type photosensitive layer contains a filler, a polyvinyl acetal resin, and oxytitanium phthalocyanine as the charge generating material, which has a main clear peak at a Bragg angle 2θ±0.2° of 27.2° in powder X-ray diffraction using a CuKα characteristic X-ray.

22. The electrophotographic photoreceptor according to the 21 above, wherein the polyvinyl acetal resin is a polyvinyl butyral resin.

23. The electrophotographic photoreceptor according to the 21 or 22 above, wherein the binder resin is a polycarbonate resin or a polyarylate resin, and 0.1 to 50 parts by mass of the polyvinyl acetal resin are contained with respect to 100 parts by mass of the binder resin.

24. The electrophotographic photoreceptor according to any one of the 21 to 23 above, wherein an energy level E_homo of HOMO obtained as a result of structural optimization calculation by density functional calculation B3LYP/6-31G (d, p) of the hole transport material satisfies the following expression:

$$E_homo > -4.65 \text{ (eV)}$$

25. A coating liquid for forming a photosensitive layer in a positive-charging single-layer type electrophotographic photoreceptor, which comprises a binder resin, a charge generating material, a hole transport material, an electron transport material and a solvent, and comprises oxytitanium phthalocyanine which has a strong diffraction peak at a Bragg angle (2θ±0.2) of 27.2° in X-ray diffraction by a CuKα ray, as the charge generating material, wherein when the coating liquid is stored under conditions of a temperature of 55° C. and relative humidity of 10%, for 96 hours, a changing rate of a half decay amount E½ in the photoreceptor is equal to or less than 75%.

26. The coating liquid for forming a photosensitive layer in a positive-charging single-layer type electrophotographic photoreceptor according to the 25 above, wherein the solvent is an organic solvent, and at least one of organic solvents is tetrahydrofuran.

27. The coating liquid for forming a photosensitive layer in a positive-charging single-layer type electrophotographic photoreceptor according to the 25 or 26 above, wherein the electron transport material is a compound represented by the following Formula (1):

Formula (1)

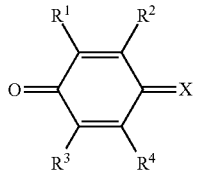

[in Formula (1), $R^1$ to $R^4$ each independently represent a hydrogen atom, an alkyl group having 1 to 20 carbon atoms which may have a substituent, or an alkenyl group having 1 to 20 carbon atoms which may have a substituent, and $R^1$ and $R^2$ are bound to each other to form a cyclic structure or $R^3$ and $R^4$ are bound to each other to form a cyclic structure, and X represents an organic residue having a molecular weight of 120 to 250.]

Advantageous Effects of Invention

According to the present invention, it is possible to provide a positive-charging single-layer type electrophotographic photoreceptor in which a very low residual potential and high sensitivity can be achieved and an occurrence of density unevenness is suppressed with maintaining charging properties, and to provide an image forming apparatus which includes the photoreceptor and has good image density.

BRIEF DESCRIPTION OF DRAWINGS

FIG. 1 is a schematic diagram illustrating a main configuration of an embodiment of an image forming apparatus according to the present invention.

FIG. 2 is an X-ray diffraction pattern of oxytitanium phthalocyanine used in an example of the present invention.

FIG. 3 is an X-ray diffraction pattern of oxytitanium phthalocyanine used in a comparative example of the present invention.

FIG. 4 is an X-ray diffraction pattern of oxytitanium phthalocyanine used in another comparative example of the present invention.

DESCRIPTION OF EMBODIMENTS

Hereinafter, an embodiment of the present invention will be described in detail. However, descriptions of configuration requirement which will be made below are just a representative example of the embodiment of the present invention, and the descriptions of configuration requirement may be appropriately changed and conducted in a range without departing from the gist of the present invention. In this specification, Me represents a methyl group, Et represents an ethyl group, nBu represents an n-butyl group, and tBu represents a t-butyl group.

<Electrophotographic Photoreceptor>

An electrophotographic photoreceptor according to the present invention is a positive charging type electrophotographic photoreceptor including a photosensitive layer on a conductive support. The photosensitive layer contains at least a charge generating material, a hole transport material, an electron transport material, and a binder resin in the same layer. An initial surface potential V0 is set to +700 V. When exposure with monochromatic light of 780 nm is performed and measurement is performed by a dynamic method, a residual potential $VL_1$ at a point at which an exposure amount for forming a latent image is 0.3 μJ/cm$^2$ is equal to or lower than 130 V, a residual potential $VL_2$ at a point at which an exposure amount for forming a latent image is 0.5 μJ/cm$^2$ is equal to or lower than 100 V, a residual potential $VL_3$ at a point at which an exposure amount for forming a latent image is 0.8 μJ/cm$^2$ is equal to or lower than 90 V, a residual potential $VL_4$ at a point at which an exposure amount for forming a latent image is 1.0 μJ/cm$^2$ is equal to or lower than 80 V, and a residual potential $VL_5$ at a point at which an exposure amount for forming a latent image is 1.5 μJ/cm$^2$ is equal to or lower than 70 V.

From a viewpoint of high speed, the residual potential $VL_1$ is preferably equal to or lower than 110 V, and more preferably equal to or lower than 100 V. The general lower limit is 50 V. From a viewpoint of high speed, the residual potential $VL_2$ is preferably equal to or lower than 80 V, and more preferably equal to or lower than 70 V. The general lower limit is 30 V. From a viewpoint of high speed, the residual potential $VL_3$ is preferably equal to or lower than 70 V, and more preferably equal to or lower than 60 V. The general lower limit is 5 V. From a viewpoint of high speed, the residual potential $VL_4$ is preferably equal to or lower than 70 V, and more preferably equal to or lower than 60 V. The general lower limit is 5 V. From a viewpoint of high speed, the residual potential $VL_5$ is preferably equal to or lower than 60 V. The general lower limit is 5 V. From a viewpoint of high speed, it is preferable that all of $VL_1$ to $VL_5$ simultaneously satisfy the above definitions.

A photoreceptor drum is rotated at the constant number of rotations of 100 rpm, and an electrical characteristic evaluation test is performed for a cycle of charging, exposure, potential measurement, and erasing. Thus, the residual potentials can be measured. The test is performed by using an electrophotographic characteristic evaluation apparatus (edited by the association of Electrophotography, "Foundation and application of electronic photography" published at 1996 by Corona Publishing Co., Ltd., pp. 404 and 405) manufactured based on the measurement standard of the association of Electrophotography. A method of performing evaluation with rotating a photoreceptor drum in this manner is referred to as a dynamic method.

In order to achieve the residual potential, for example, (A) the following technique is exemplified. That is, a photosensitive layer of an electrophotographic photoreceptor is formed by using a coating liquid which is obtained by mixing a coating liquid in which a binder resin, a charge generating material such as a metal phthalocyanine compound, which has high sensitivity, a filler, and the like are dispersed, and a coating liquid in which a hole transport material such as a dienamine compound, which has a low residual potential, an electron transport material, and the like are dispersed. For example, the following techniques are exemplified: (B) a technique of being defined to contain a binder resin, a charge generating material such as a metal phthalocyanine compound, which has high sensitivity, a hole transport material such as a dienamine compound, which has a low residual potential, an electron transport material, a filler, a binder resin, and a polyvinyl acetal resin; and (C) a technique of containing an electron transport material having high performance while a large amount of a charge generating material such as a phthalocyanine compound, which has high sensitivity is used.

[Conductive Support]

The conductive support is not particularly limited. For example, the followings are mainly used: a metal material such as aluminum, aluminum alloys, stainless steel, copper, and nickel; a resin material obtained by adding conductive powder particles of metal, carbon, tin oxide, or the like so as to impart conductivity; and a resin, glass, paper, and the like in which a conductive material such as aluminum, nickel, and indium oxide-tin oxide (ITO) is evaporated or applied onto the surface. The above materials may be singly used. A certain combination of two types or more at a certain proportion may be used. Examples of the shape of the conductive support include a drum shape, a sheet shape, and a belt shape. Further, for example, a support in which a conductive material having an appropriate resistance value is applied onto a conductive support formed of a metal material, in order to control conductivity or surface properties or to coat a defect is exemplified.

In a case where a metal material such as aluminum alloy is used as the conductive support, the conductive support may be coated with an anodic oxide film, and then may be used. In a case where coating with an anodic oxide film has been performed, a support subjected to sealing treatment by well-known methods is preferable. The surface of the support may be smooth. The surface of the support may be roughened by using a special cutting method or by performing roughening treatment. In addition, roughening may be performed by mixing particles having an appropriate particle diameter, to a material constituting the support. In order to reduce price, a drawn pipe itself may be used without performing cutting treatment.

[Undercoat Layer]

An undercoat layer may be provided between the conductive support and the photosensitive layer, in order to improve adhesiveness, blocking properties, and the like. Examples of the undercoat layer include a layer formed of only a resin and a layer in which particles of metal oxide and the like, an organic pigment, and the like are dispersed in a resin. Examples of the metal oxide particle used in the undercoat layer include a particle of metal oxide which includes one type of metal element, such as titanium oxide, aluminum oxide, silicon oxide, zirconium oxide, zinc oxide, and iron oxide; and a particle of metal oxide which includes plural types of metal elements, such as calcium titanate, strontium titanate, and barium titanate. As described above, particles of only one type may be used or particles of plural types may be used in combination. Among the metal oxide particles, titanium oxide and aluminum oxide are preferable, and titanium oxide is particularly preferable.

The surface of a titanium oxide particle may be subjected to treatment by an inorganic matter such as tin oxide, aluminum oxide, antimony oxide, zirconium oxide, or silicon oxide, or by an organic matter such as stearic acid, polyol, or silicone. As a crystal form of the titanium oxide particle, any of rutile, anatase, brookite, and amorphous forms can be used. A particle having plural types of crystalline states may be included.

Regarding a particle diameter of the metal oxide particles, various particles can be used. Among the particles, from a viewpoint of characteristics and stability of a coating liquid, an average primary particle diameter is preferably 1 nm to 100 nm, and is particularly preferably 10 nm to 50 nm.

It is preferable that the undercoat layer is formed in a form in which metal oxide particles are dispersed in a binder resin. Examples of the binder resin used in the undercoat layer include phenoxy, epoxy, polyvinyl pyrrolidone, polyvinyl alcohol, casein, polyacrylic acid, celluloses, gelatin, starch, polyurethane, polyimide, and polyamide. The above substances have a form of being singly cured or a form of being cured along with a curing agent. Among the substances, copolymerized polyamide, modified polyamide, or the like which can dissolve alcohol are preferable because of showing good dispersibility and coating properties.

A layer corresponding to a charge generation layer which constitutes a laminate type photoreceptor can be set as the undercoat layer. In this case, a layer obtained by coating with a resultant which is obtained by dispersing a phthalocyanine pigment, an azo pigment, or a perylene pigment in a binder resin is preferably used. In this case, there is a case where adhesiveness or electrical characteristics are particularly excellent. Thus, this case is preferable. Polyvinyl acetal resins are preferably used as the binder resin. In particular, a polyvinyl butyral resin is preferably used.

An addition ratio of a dispersant such as a particle or a pigment, to the binder resin is randomly selected. However, using at the addition ratio in a preferable range of 10 mass % to 500 mass % is preferable in an aspect of stability and coating properties of a dispersion liquid. The film thickness of the undercoat layer can be randomly selected. However, the film thickness thereof is preferably 0.1 μm to 25 μm from a viewpoint of photoreceptor characteristics and coating properties. Well-known oxidant inhibitors and the like may be added to the undercoat layer. Some layers having a different configuration may be provided as the undercoat layer.

[Photosensitive Layer]

A photosensitive layer (may be referred to as a single-layer type photosensitive layer below) is formed on the conductive support. The photosensitive layer contains at least a charge generating material, a hole transport material, an electron transport material, and a binder resin on the same layer. From a viewpoint of a long lifespan and image stability, the film thickness of the single-layer type photosensitive layer is preferably equal to or less than 45 μm. From a viewpoint of high resolution, the film thickness thereof is preferably equal to or less than 40 μm. The film thickness thereof is more preferably equal to or more than 15 μm from a viewpoint of image stability, and is more preferably equal to or more than 20 μm from a viewpoint of a long lifespan.

The followings are preferable. An electrophotographic photoreceptor is a positive charging electrophotographic photoreceptor including a single-layer type photosensitive layer on a conductive support. The single-layer type photosensitive layer contains at least a charge generating material, a hole transport material, an electron transport material, and a binder resin in the same layer. As the specific configuration, the single-layer type photosensitive layer contains a filler, a polyvinyl acetal resin, and oxytitanium phthalocyanine as the charge generating material. The oxytitanium phthalocyanine has a main clear peak at a Bragg angle 2θ±0.2° of 27.2° in powder X-ray diffraction using a CuKα characteristic X-ray.

The reason is because oxytitanium phthalocyanine which has high sensitivity, but has crystal which is easily transformed, and shows a main clear peak at a Bragg angle 2θ±0.2° of 27.2° is protected by a polyvinyl acetal resin, and the protected phthalocyanine can be uniformly dispersed in the binder resin by the filler.

[Charge Generating Material]

Examples of the charge generating material include an inorganic photoconductive material such as selenium and alloys thereof, and cadmium sulfide, and an organic photoconductive material such as an organic pigment. Among the substances, the organic photoconductive material is preferable, and the organic pigment is particularly preferable. Examples of the organic pigment include phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments, and benzimidazole pigments. Among the pigments, the phthalocyanine pigment or the azo pigment is particularly preferable. In a case where an organic pigment is used as the charge generating material, generally, the organic pigment is used in a form of a dispersion layer in which fine particles of the organic pigment are bound to various binder resins.

In a case where a phthalocyanine pigment is used as the charge generating material, specific examples thereof include metal-free phthalocyanine; substances having crystal types of phthalocyanines in which metal such as copper, indium, gallium, tin, titanium, zinc, vanadium, silicon, germanium, and aluminum, oxide thereof, halide thereof, hydroxide thereof, alkoxide thereof, and the like are coordinated; and phthalocyanine dimers which use an oxygen atom as a crosslinking atom. From a viewpoint of high sensitivity, metal phthalocyanine is preferable.

In particular, metal-free phthalocyanine of an X type or a τ type which is a crystal type having high sensitivity; titanyl phthalocyanine (another name: oxytitanium phthalocyanine) of an A type (another name: β type), a B type (another name: α type), a D type (another name: Y type), or the like; vanadyl phthalocyanine, chloroindium phthalocyanine, hydroxy indium phthalocyanine; chlorogallium phthalocyanine of a II type or the like; hydroxygallium phthalocyanine of a V type or the like; μ-oxo-gallium phthalocyanine dimers of a G type, an I type, or the like; or μ-oxo-aluminum phthalocyanine dimers of a II type or the like is preferable.

Among these types of phthalocyanine, titanyl phthalocyanine of the A type (another name: β type), the B type (another name: α type), and the D type (Y type) in which a clear peak is shown at a diffraction angle 2θ(±0.2°) in powder X-ray diffraction, which is 27.1° or 27.3°; the II type chlorogallium phthalocyanine; hydroxygallium phthalocyanine which has the V type, has a strongest peak at 28.1°, has a clear peak at 28.1° without a peak at 26.2°, and has a half value width W at 25.9°, which satisfies 0.1°≤W≤0.4°; the G type μ-oxo-gallium phthalocyanine dimers, and the like are particularly preferable.

Among the substances, from a viewpoint of realizing a low residual potential, oxytitanium phthalocyanine which shows a main clear peak at a Bragg angle (2θ±0.2°) of 27.2° in a powder X-ray diffraction spectrum by a CuKα characteristic X-ray is preferably used. The "main clear peak" means a peak having the strongest peak intensity or a peak having the sharpest peak form (see JP-A-2-289658 and JP-A-2007-122076). A composition containing various titanyl phthalocyanine derivatives such as titanyl phthalocyanine having a substituent may be provided.

It is preferable that the oxytitanium phthalocyanine has main diffraction peaks at a Bragg angle (2θ±0.2°) of 9.0° to 9.7° in a powder X-ray diffraction spectrum by a CuKα characteristic X-ray. From a viewpoint of electrophotographic photoreceptor characteristics, it is preferable that the oxytitanium phthalocyanine has main diffraction peaks at 9.6°, 24.1°, and 27.2° or at 9.5°, 9.7°, 24.1°, and 27.2°. From a viewpoint of stability at a time of dispersion, it is preferable that the oxytitanium phthalocyanine does not have a peak in the vicinity of 26.2°. Among the above-described oxytitanium phthalocyanine substances, it is more preferable that oxytitanium phthalocyanine having main diffraction peaks at 7.3°, 9.6°, 11.6°, 14.2°, 18.0°, 24.1°, and 27.2°, or at 7.3°, 9.5°, 9.7°, 11.6°, 14.2°, 18.0°, 24.2°, and 27.2°.

The crystal forms are mainly manufactured by crystal transformation from amorphous or low-crystalline oxytitanium phthalocyanine. The followings are known: the crystal forms are a semi-stable type crystal form; various crystal forms or various particulate shapes are shown according to variety of manufacturing methods; and characteristics as an electrophotographic photoreceptor, such as charge generation capability, charging properties or dark attenuation also depend on manufacturing methods.

As a solvent capable of being used in crystal transformation, any of a solvent having compatibility with water, and a solvent having non-compatibility with water can be used. Preferable examples of the solvent having compatibility with water include cyclic ether such as tetrahydrofuran, 1,4-dioxane, and 1,3-dioxolane.

Preferable examples of the solvent having non-compatibility with water include an aromatic hydrocarbon solvent such as toluene, naphthalene, and methyl naphthalene; a halogen solvent such as chlorotoluene, o-dichlorotoluene, dichlorofluorobenzene, and 1,2-dichloroethane; and a substituted aromatic solvent such as nitrobenzene, 1,2-methylene dioxybenzene, and acetophenone. Among the substances, cyclic ether, chlorotoluene, a halogenated hydrocarbon solvent, or an aromatic hydrocarbon solvent is preferable because electrophotographic characteristics of the obtained crystal are good. Tetrahydrofuran, o-dichlorobenzene, 1,2-dichlorotoluene, dichlorofluorobenzene, toluene, or naphthalene is more preferable in a point of stability of the obtained crystal at a time of dispersion.

Crystal obtained after crystal transformation is subjected to a dry process. However, regarding a dry method, drying may be performed by using well-known methods such as air drying, heat drying, vacuum drying, or freeze drying.

The phthalocyanine compounds may be singly used or may be used in a mixture or in a mixed crystalline state of some compounds. Here, as a mixed state in which the phthalocyanine compound and the like are in a crystalline state, a mixture obtained by mixing the components later may be used or the mixed state may be caused in a manufacturing and treatment process of a phthalocyanine compound, such as synthesis, pigmentation, or crystallization. Examples of such treatment include acid paste treatment, grinding treatment, and solvent treatment. In order to cause the mixed crystalline state, as disclosed in JP-A-10-48859, a method in which, after two types of crystals are mixed, the mixture is mechanically ground so as to perform amorphizing, and then solvent treatment is performed to perform conversion to a specific crystalline state is exemplified.

Regarding a mixing ratio (mass) of the binder resin and the oxytitanium phthalocyanine, from a viewpoint of charge generation efficiency, the oxytitanium phthalocyanine is in a range of being generally equal to or more than 0.1 parts by mass, and preferably equal to or more than 1 parts by mass, with respect to 100 parts by mass of the binder resin in the photosensitive layer. From a viewpoint of dispersibility, the oxytitanium phthalocyanine is in a range of being generally equal to or less than 20 parts by mass, preferably equal to or less than 10 parts by mass, and preferably equal to or less than 5 parts by mass. The particle diameter of the oxytitanium phthalocyanine is generally equal to or less than 1 μm. From a viewpoint of dispersibility, it is preferable that particles having a particle diameter of 0.5 μm or less are used.

[Hole Transport Material]

In the photosensitive layer in the present invention, examples of the hole transport material include heterocyclic compounds such as carbazole derivatives, indole derivatives, imidazole derivatives, oxazole derivatives, pyrazole derivatives, thiadiazole derivatives, and benzofuran derivatives; aniline derivatives, hydrazone derivatives, aromatic amine derivatives, arylamine derivatives, stilbene derivatives, butadiene derivatives, enamine derivatives, and compounds obtained by combining plural types of the above compounds; and electron donating substances such as polymer having a group consisting of the above compounds, in the main chain or a side chain. Among these compounds, carbazole derivatives, aromatic amine derivatives, arylamine derivatives, stilbene derivatives, butadiene derivatives, enamine derivatives, and compounds obtained by combining plural types of the above compounds are preferable.

From a viewpoint of achieving a low residual potential, regarding an energy level E_homo of HOMO by structural optimization calculation using B3LYP/6-31G(d, p) of the hole transport material, E_homo>−4.65 (eV) is preferable, and E_homo>−4.63 (eV) is more preferable. This is because an excellent electrophotographic photoreceptor in which a potential after exposure is lowered as the energy level of HOMO becomes higher is obtained.

From a viewpoint of gas resistance and ghost, E_homo<−4.20 (eV) is general, and E_homo<−4.30 (eV) is preferable. It is preferable that a calculation value αcal of polarizability α obtained by HF/6-31G(d, p) calculation in a stable structure obtained after structural optimization calculation using B3LYP/6-31G(d, p) satisfies αcal>80 ($Å^3$). The reason is follows. A charge transport film containing a charge transport material which has a large value of αcal shows high charge mobility. The charge transport film is used, and thus an electrophotographic photoreceptor which is excellent in charging properties, sensitivity, and the like is obtained. From a viewpoint of solubility of the charge transport material, αcal<200 ($Å^3$) is general, and αcal<150 ($Å^3$) is preferable.

The number of hole transport materials which are used together is not particularly limited. An example of a formula having a preferable structure, as the hole transport material will be described below. The following formulas are just described for exemplification, and well-known electron transport materials may be used in the present invention, in a range without departing from the purpose of the present invention.
HTM1
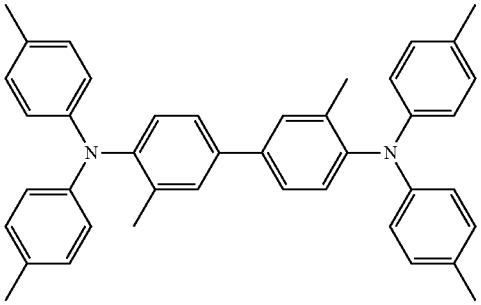
HTM2
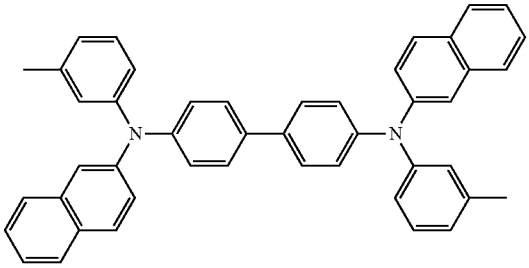
HTM3
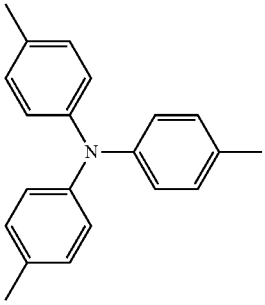
HTM4
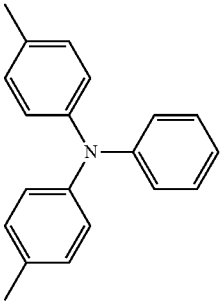
HTM5
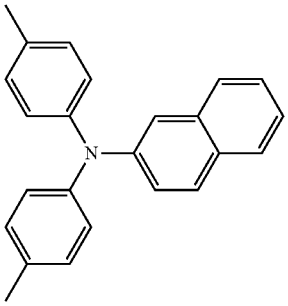
HTM6
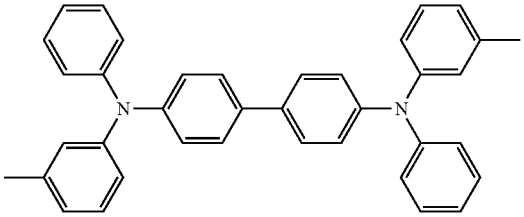
HTM7
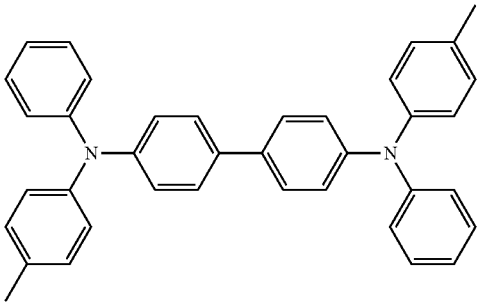
HTM8
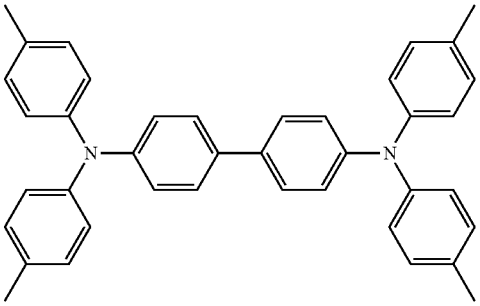

-continued
HTM9
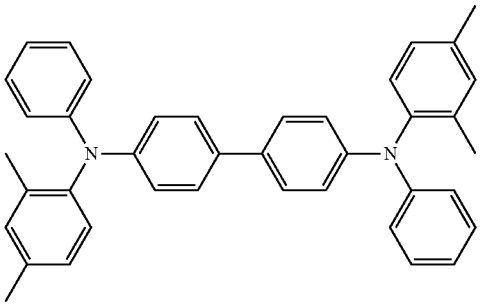
HTM10
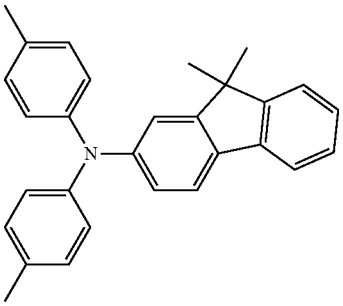
HTM11
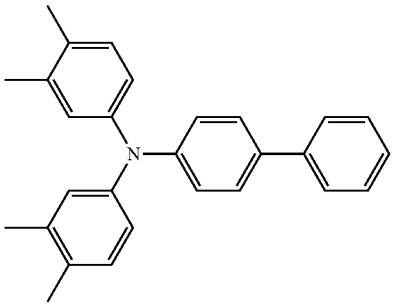
HTM12
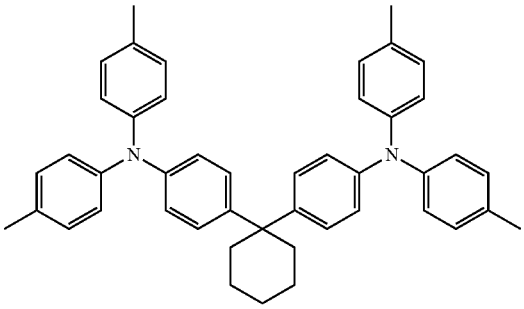
HTM13
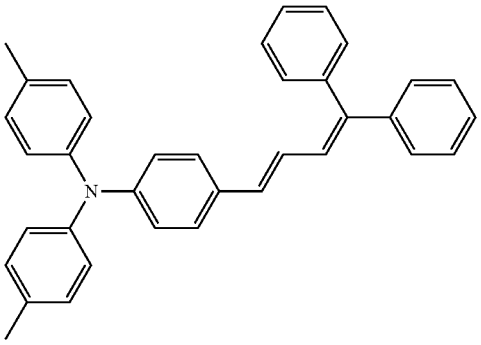
HTM14
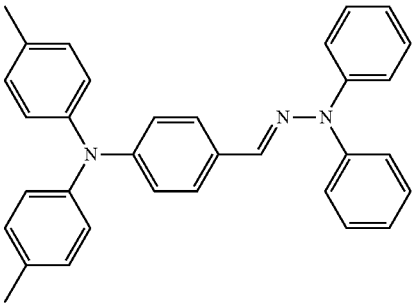
HTM15
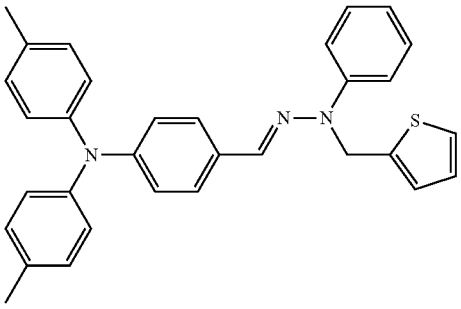
HTM16
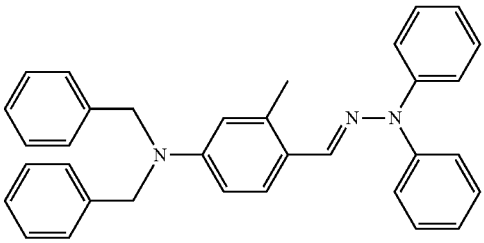

-continued
HTM17
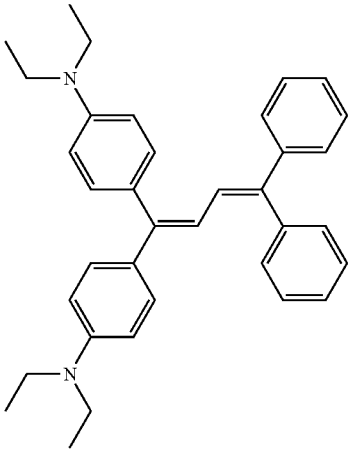
HTM18
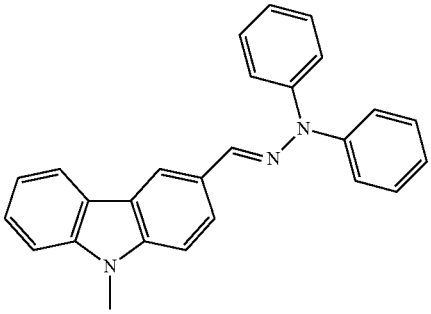
HTM19
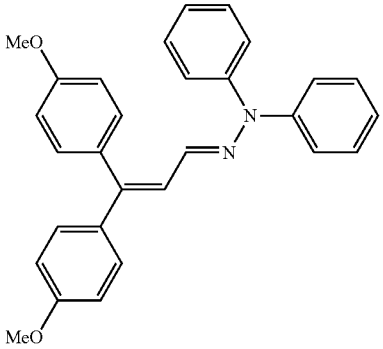
HTM20
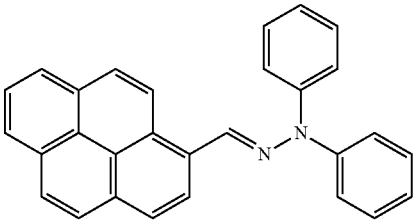
HTM21
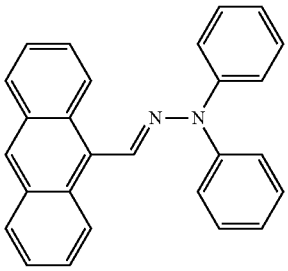
HTM22
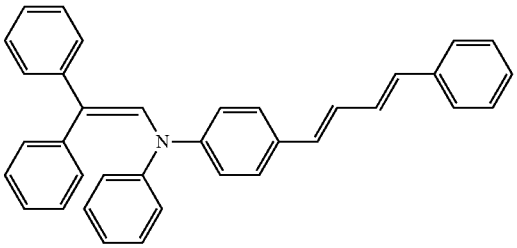
HTM23
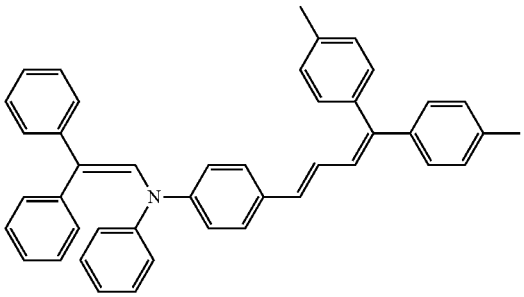
HTM24
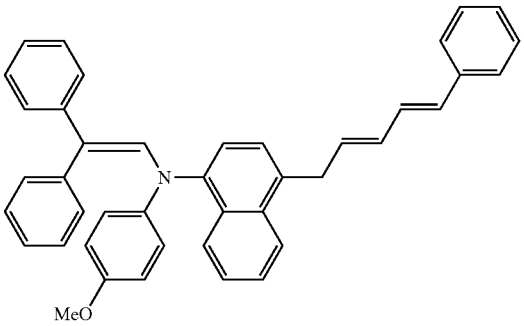

-continued
HTM25
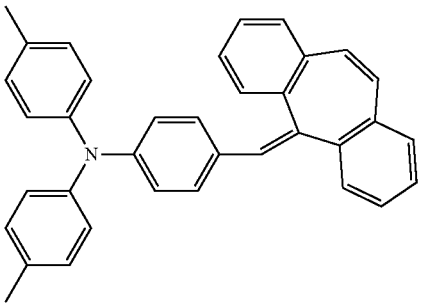
HTM26
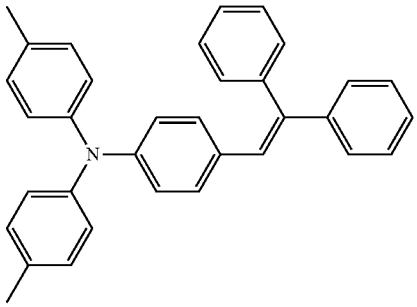
HTM27
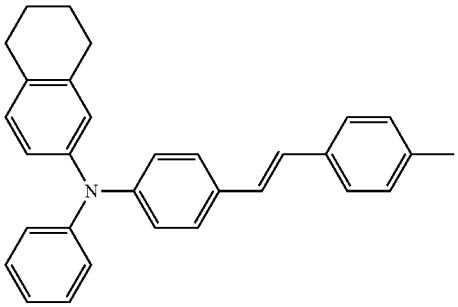
HTM28
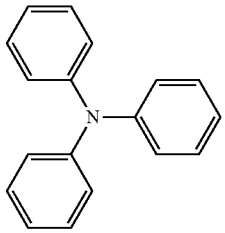
HTM29
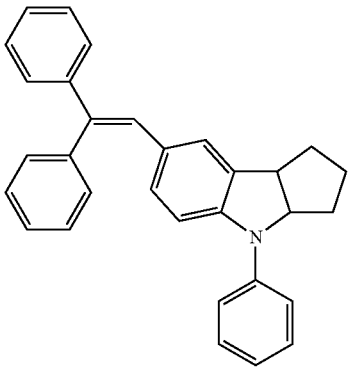
HTM30
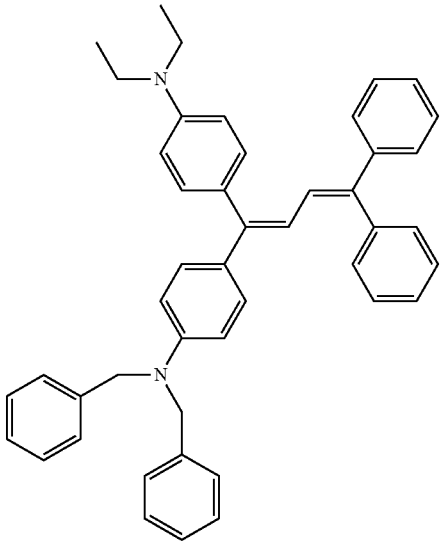
HTM31
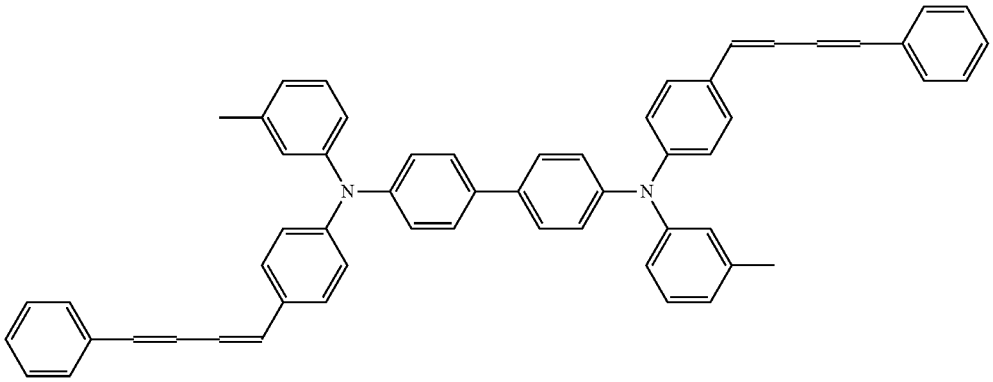

-continued
HTM32
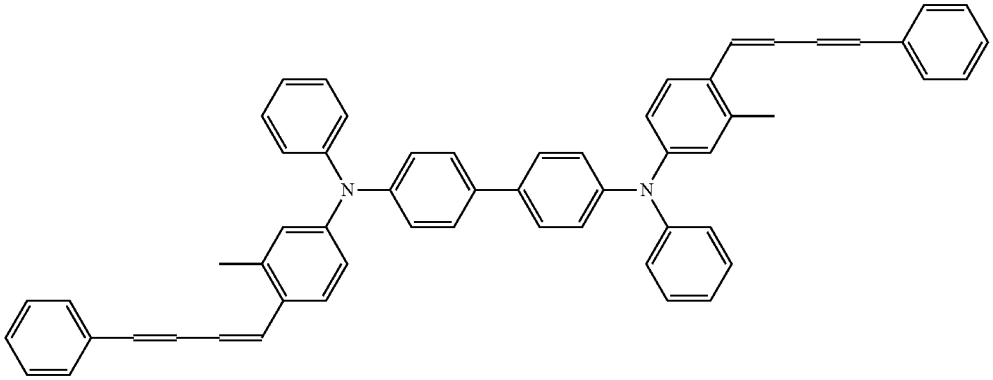
HTM33
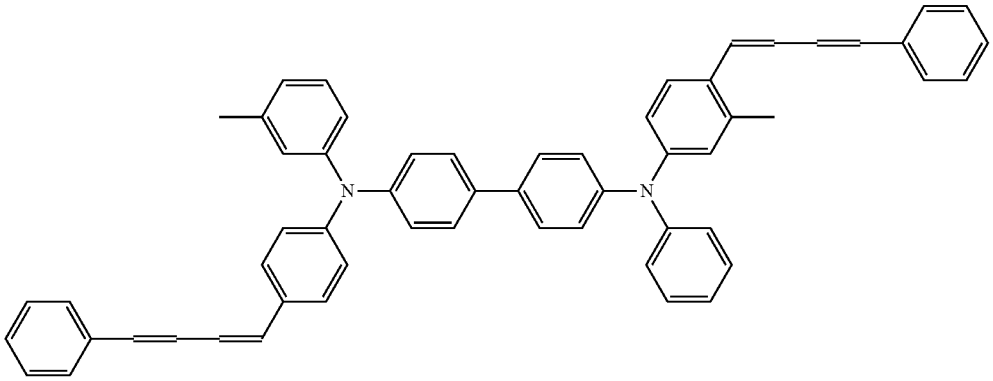
HTM34
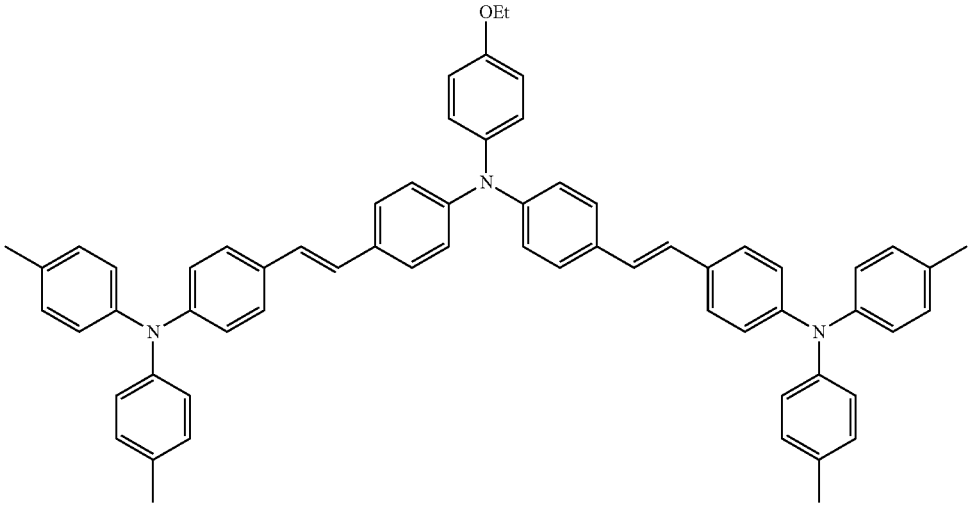

-continued
HTM35
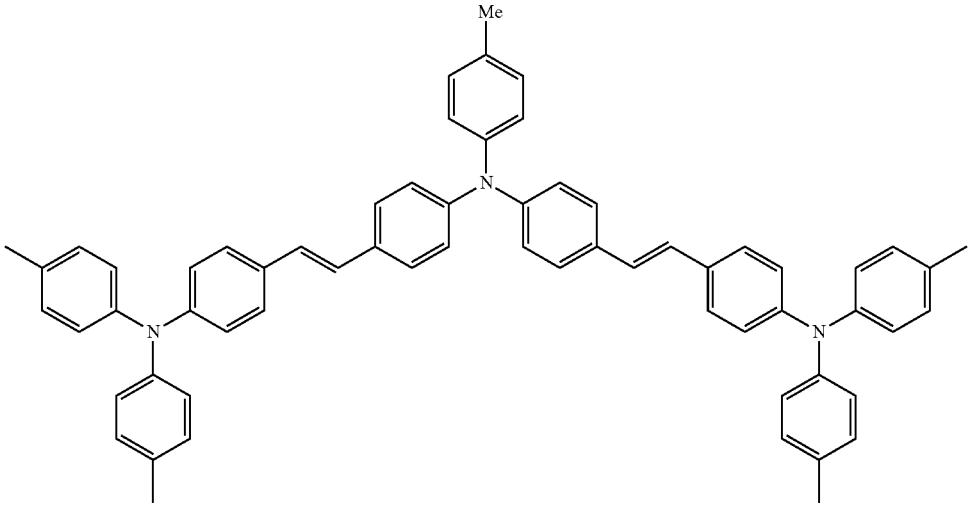
HTM36
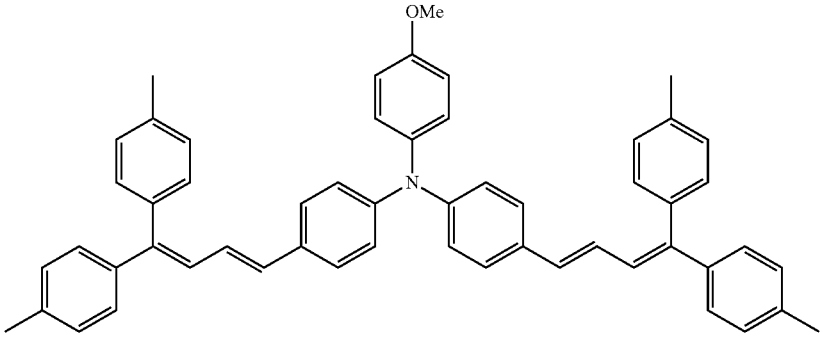
HTM37
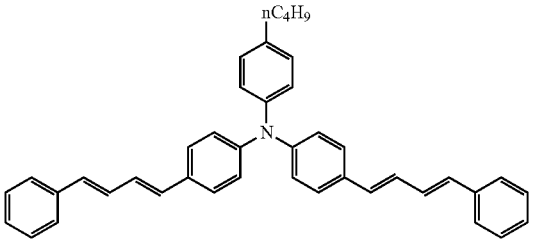
HTM38
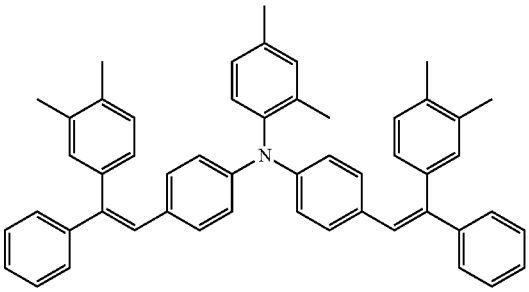
HTM39
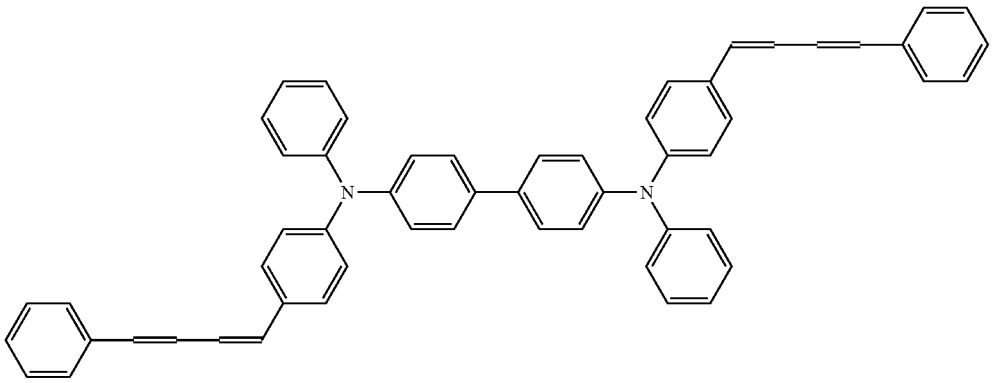

-continued
HTM40
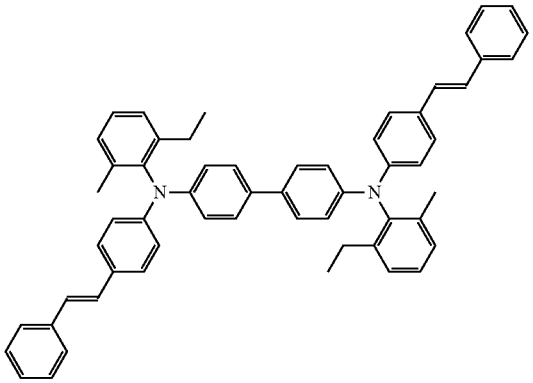
HTM41
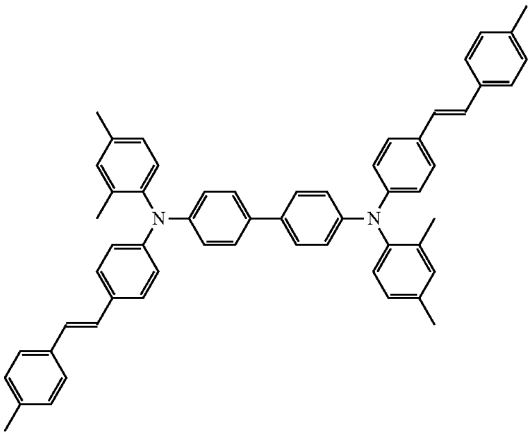
HTM42
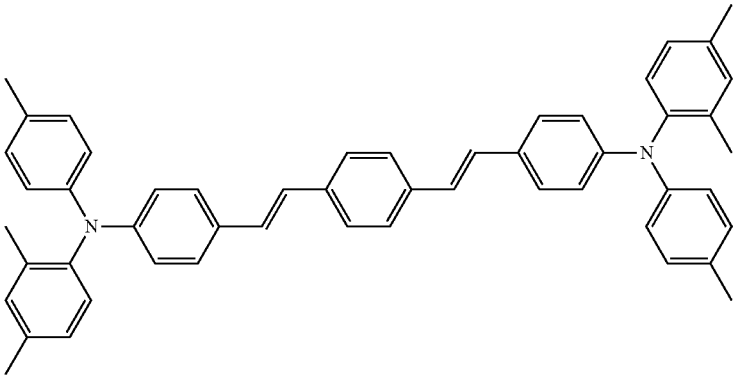
HTM43
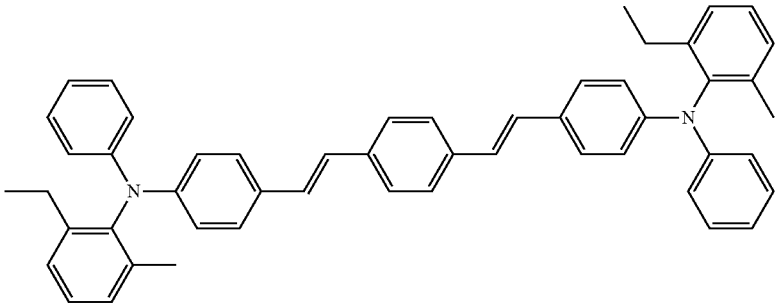
HTM44
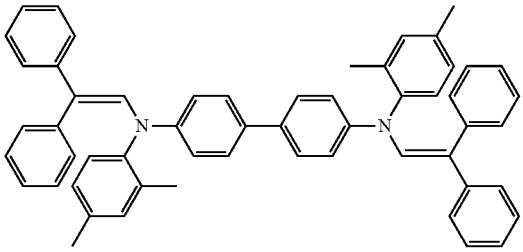
HTM45
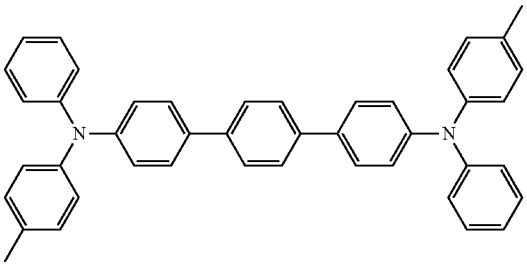

-continued

HTM46

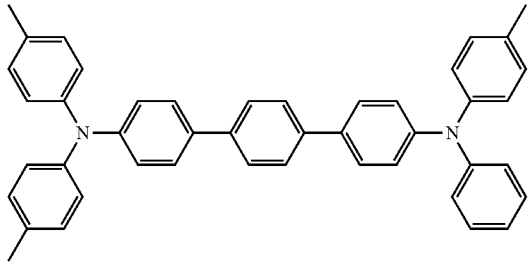

HTM47

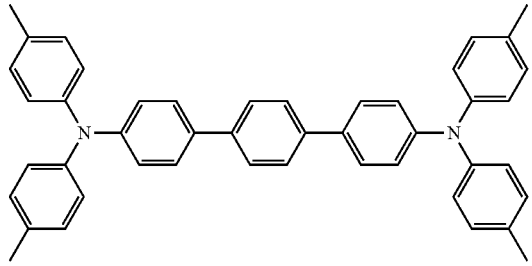

Among the hole transport materials, from a viewpoint of a residual potential, compounds having structures of HTM34, 35, 39, 41, and 44 are preferable.

Regarding the percentage of the binder resin and the hole transport material in the photosensitive layer, generally, 20 parts by mass or more of the hole transport material with respect to 100 parts by mass of the binder resin in the same layer are used. From a viewpoint of reducing a residual potential, the hole transport material is preferably equal to or more than 30 parts by mass. From a viewpoint of stability or charge mobility at a time of being repeatedly used, the hole transport material is more preferably equal to or more than 40 parts by mass. Generally, 100 parts by mass or less of the charge transport material with respect to 100 parts by mass of the binder resin in the same layer are used. From a viewpoint of compatibility between the electron transport material and the binder resin, the charge transport material is preferably equal to or less than 80 parts by mass.

[Electron Transport Material]

It is preferable that the photosensitive layer contains a compound represented by the following Formula (1), as the electron transport material.

Formula (1)

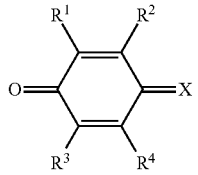

In Formula (1), $R^1$ to $R^4$ each independently represent a hydrogen atom, an alkyl group having 1 to 20 carbon atoms which may have a substituent, or an alkenyl group having 1 to 20 carbon atoms which may have a substituent, and $R^1$ and $R^2$ are bound to each other to form a cyclic structure or $R^3$ and $R^4$ are bound to each other to form a cyclic structure. X represents an organic residue having a molecular weight of 120 to 250.

$R^1$ to $R^4$ each independently represent a hydrogen atom, an alkyl group having 1 to 20 carbon atoms which may have a substituent, or an alkenyl group having 1 to 20 carbon atoms which may have a substituent. Examples of the alkyl group which has 1 to 20 carbon atoms and may have a substituent include a straight-chain alkyl group such as a methyl group, an ethyl group, and a hexyl group; a branched alkyl group such as an iso-propyl group, a tert-butyl group, and a tert-amyl group; and a cyclic alkyl group such as a cyclohexyl group and a cyclopentyl group. Among the above groups, from a viewpoint of versatility of a raw material, an alkyl group having 1 to 15 carbon atoms is preferable. From a viewpoint of handling properties in manufacturing, an alkyl group having 1 to 10 carbon atoms is more preferable, and an alkyl group having 1 to 5 carbon atoms is further preferable. From a viewpoint of electron transport capability, a straight-chain alkyl group or a branched alkyl group is preferable. Among the groups, a methyl group, a tert-butyl group, or a tert-amyl group is more preferable. From a viewpoint of solubility in an organic solvent used in a coating liquid, a tert-butyl group, or a tert-amyl group is further preferable.

Examples of the alkenyl group having 1 to 20 carbon atoms which may have a substituent include a straight-chain alkenyl group such as an ethenyl group; a branched alkenyl group such as a 2-methyl-1-propenyl group; and a cyclic alkenyl group such as a cyclohexenyl group. Among the above groups, from a viewpoint of light attenuation characteristics of a photoreceptor, an straight-chain alkenyl group having 1 to 10 carbon atoms is preferable.

In the substituents $R^1$ to $R^4$, $R^1$ and $R^2$ or $R^3$ and $R^4$ may be bound to each other so as to form a cyclic structure. From a viewpoint of electron mobility, in a case where both of $R^1$ and $R^2$ are alkenyl groups, it is preferable that $R^1$ and $R^2$ are bound to each other so as to form an aromatic ring. If both of $R^1$ and $R^2$ are ethenyl groups, it is more preferable that $R^1$ and $R^2$ are bound to each other so as to have a benzene ring structure.

In Formula (1), X represents an organic residue having a molecular weight of 120 to 250. From a viewpoint of light attenuation characteristics of a photoreceptor, X is preferably any one of organic residues represented by the following Formulas (2) to (5).

Formula (2)

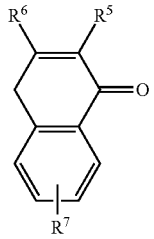

In Formula (2), $R^5$ to $R^7$ each independently represent a hydrogen atom or an alkyl group having 1 to 6 carbon atoms.

Formula (3)

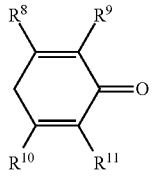

In Formula (3), $R^8$ to $R^{11}$ each independently represent a hydrogen atom, a halogen atom, or an alkyl group having 1 to 6 carbon atoms.

Formula (4)

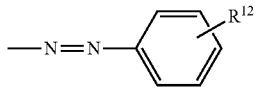

In Formula (4), $R^{12}$ represents a hydrogen atom, an alkyl group having 1 to 6 carbon atoms, or a halogen atom.

Formula (5)

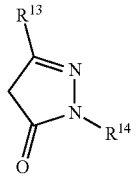

In Formula (5), $R^{13}$ and $R^{14}$ each independently represent a hydrogen atom, an alkyl group having 1 to 6 carbon atoms, or an aryl group having 6 to 12 carbon atoms.

Examples of the alkyl group having 1 to 6 carbon atoms in $R^5$ to $R^{14}$ include a straight-chain alkyl group such as a methyl group, an ethyl group, and a hexyl group; a branched alkyl group such as an iso-propyl group, a tert-butyl group, and a tert-amyl group; and a cyclic alkyl group such as a cyclohexyl group. From a viewpoint of electron transport capability, a methyl group, a tert-butyl group, or a tert-amyl group is more preferable. Examples of the halogen atom include atoms of fluorine, chlorine, bromine, and iodine. From a viewpoint of electron transport capability, chlorine is preferable. Examples of an aryl group having 6 to 12 carbon atoms include a phenyl group and a naphthyl group. From a viewpoint of film properties of a photosensitive layer, a phenyl group or a naphthyl group is preferable, and the phenyl group is more preferable. Regarding X, in Formulas (2) to (5), from a viewpoint of image quality stability when images are repeatedly formed, Formula (3) or (4) is preferable, and Formula (3) is more preferable.

The compound represented by Formula (1) may be singly used, and may be used along with a compound which has a different structure and is represented by Formula (1). In addition, the compound can be used along with the electron transport material.

A preferable structure of the electron transport material in the present invention will be exemplified below. The following structures are just examples for specifically describing the present invention, and it is not limited to the following structures in a range without departing from the concept of the present invention.

ET-1

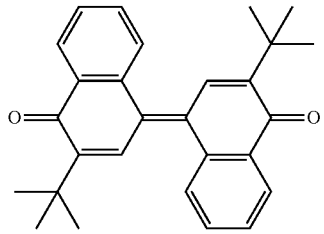

ET-2

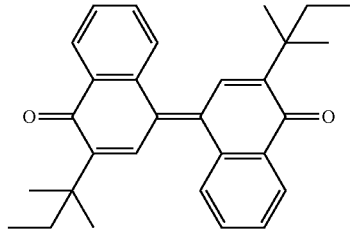

ET-3

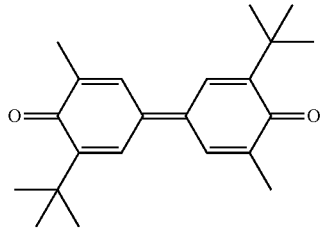

ET-4

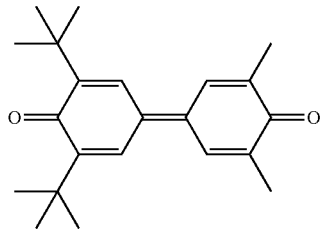

ET-5

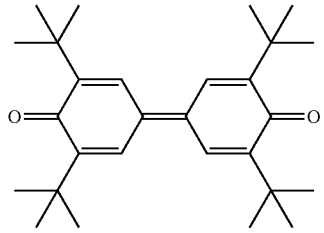

ET-6

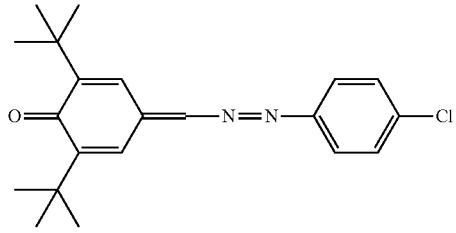

-continued

ET-7

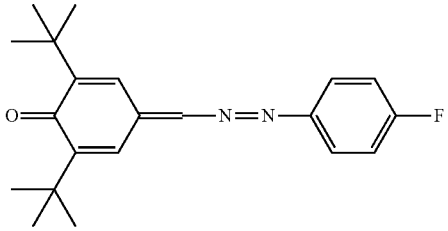

ET-8

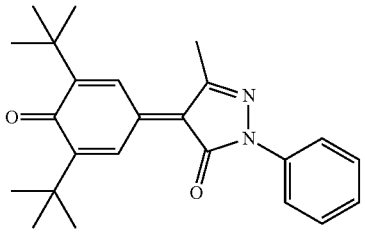

Regarding the percentage of the binder resin and the electron transport material in the photosensitive layer, generally, 5 parts by mass or more of the electron transport material with respect to 100 parts by mass of the binder resin are used. From a viewpoint of reducing a residual potential, the electron transport material is preferably equal to or more than 10 parts by mass. From a viewpoint of stability or charge mobility at a time of being repeatedly used, the electron transport material is more preferably equal to or more than 20 parts by mass. From a viewpoint of thermal stability of the photosensitive layer, 100 parts by mass or less of the charge transport material are generally used. From a viewpoint of compatibility between the electron transport material and the binder resin, the electron transport material is preferably equal to or less than 80 parts by mass, more preferably equal to or less than 60 parts by mass, and further preferably equal to or less than 50 parts by mass.

A mixing ratio of the binder resin and the charge transport material (electron transport material and/or hole transport material) which constitute the photosensitive layer are randomly set. However, generally, mixing is performed at a ratio of 20 parts by mass or more of the charge transport material with respect to 100 parts by mass of the binder resin. In the above ratio, from a viewpoint of reducing a residual potential, the charge transport material is preferably mixed at a ratio of 30 parts by mass or more, with respect to 100 parts by mass of the binder resin. From a viewpoint of stability or charge mobility at a time of being repeatedly used, the charge transport material is preferably mixed at a ratio of 40 parts by mass or more.

From a viewpoint of thermal stability of the photosensitive layer, the charge transport material is preferably mixed at a ratio of 200 parts by mass or less, with respect to 100 parts by mass of the binder resin. Further, from a viewpoint of compatibility between the charge transport material and the binder resin, the charge transport material is more preferably mixed at a ratio of 150 parts by mass or less, further preferably mixed at a ratio of 125 parts by mass or less, and particularly preferably mixed at a ratio of 100 parts by mass or less. In a case using plural types of charge transport materials, the total of the used charge transport materials is set to be in the above range.

[Binder Resin]

Examples of the binder resin include polymers and copolymers of vinyl compounds such as butadiene resins, styrene resins, vinyl acetate resins, vinyl chloride resins, acrylate ester resins, methacrylate ester resins, vinyl alcohol resins, and ethyl vinyl ether, polyvinyl butyral resins, polyvinyl formal resins, polyvinyl acetal resins, polyethylene terephthalate resins, polycarbonate resins, polyester resins, polyarylate resins, polyamide resins, polyurethane resins, cellulose ester resins, phenoxy resins, silicone resins, silicon-alkyd resins, and poly-N-vinylcarbazole resins. The binder resins can be used in a form of being cross-linked by heat, light, and the like with an appropriate curing agent. A certain combination of two types or more of binder resins may be used. Among the binder resins, from a viewpoint of electrical characteristics and dispersibility, a polyvinyl acetal resin, a polycarbonate resin, a polyester resin, or a polyarylate resin is preferable.

In the preferable resins, from a viewpoint of electrical characteristics and dispersibility, a resin having a unit structure which is represented by the following Formula (6) is preferably used.

Formula (6)

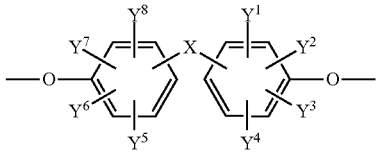

In Formula (6), X represents a single bond or a linking group. $Y^1$ to $Y^8$ each independently represent a hydrogen atom or an alkyl group.

It is preferable that X represents a single bond or a group represented by the following structure in Formula (6). The "single bond" is referred to as a state where not an atom functioning as "X" but two benzene rings in the right and left in Formula (6) are bound to simply each other in a manner of single bond.

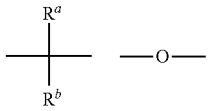

In the structural formula, $R^a$ and $R^b$ each independently represent a hydrogen atom, an alkyl group having 1 to 20 carbon atoms, or an aryl group having 1 to 20 carbon atoms. $R^a$ and $R^b$ may be bound to each other so as to form a cyclic alkyl structure having 5 to 12 carbon atoms. Examples of the alkyl group include a straight-chain alkyl group such as a methyl group, an ethyl group, an n-propyl group, an n-butyl group, an n-hexyl group, and an n-octyl group; a branched alkyl group such as an isopropyl group, an ethylhexyl group, and a tertiary butyl group; and a cyclic alkyl group such as a cyclohexyl group. Among the groups, from a viewpoint of the electrical characteristics, a methyl group or an ethyl group is preferable. Examples of the aryl group include a phenyl group, a naphthyl group, a biphenyl group, an anthryl group, a phenanthryl group, a tolyl group, and an anisyl group. As the alkyl group for $Y^1$ to $Y^8$, a group exemplified as $R^a$ and $R^b$ can be applied.

In particular, as a binder resin having a molecular structure which is represented by Formula (6), from a viewpoint of film forming properties of a photosensitive layer and characteristics of an electrophotographic photoreceptor, a polycarbonate resin or a polyarylate resin is preferable. The structure of bisphenol or biphenol which can be preferably used in a polycarbonate resin or a polyarylate resin is exemplified below. The following examples are just used for clarifying the gist of the present invention, and it is not limited to the exemplified structure in a range without departing from the gist of the present invention.

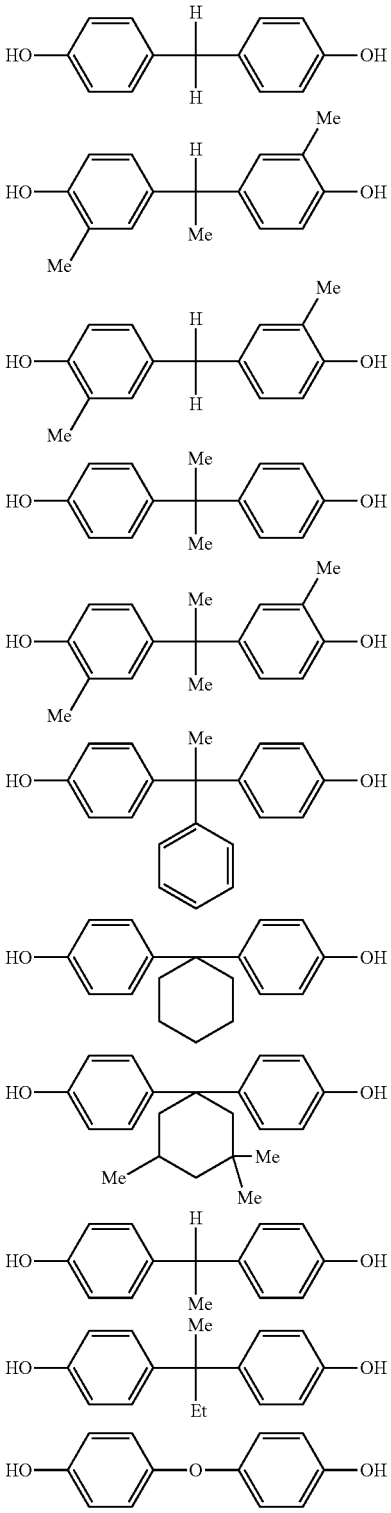

-continued

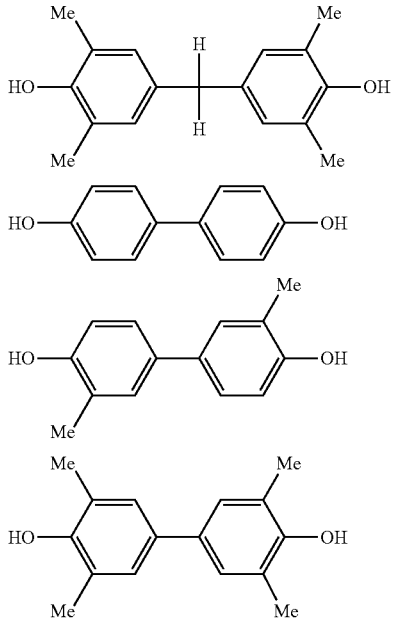

In particular, in order to maximize the effect of the present invention, a polycarbonate or polyarylate resin synthesized from derivatives of bisphenol or biphenol having the following structure is preferable.

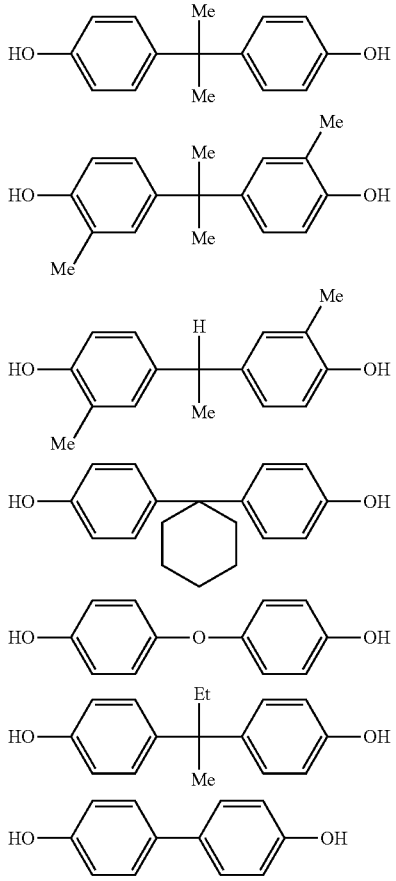

-continued

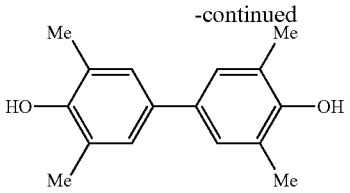

An example of a formula having a preferable structure as the binder resin will be described below. The formula will be described as just an example, and it is not limited to the following structures.

[Polyvinyl Acetal Resin]

The binder resin in the photosensitive layer maintains the crystal form of oxytitanium phthalocyanine. From a viewpoint of securing a low residual potential, the binder resin and a polyvinyl acetal resin are preferably used together. Examples of the polyvinyl acetal resin include a polyvinyl butyral resin, a polyvinyl formal resin, and a partially-acetalized polyvinyl butyral resin in which a portion of a butyral is modified by formal, acetal, or the like. From a viewpoint of dispersibility, a polyvinyl acetal resin including a structural unit which is represented by the following structural formula is preferable.

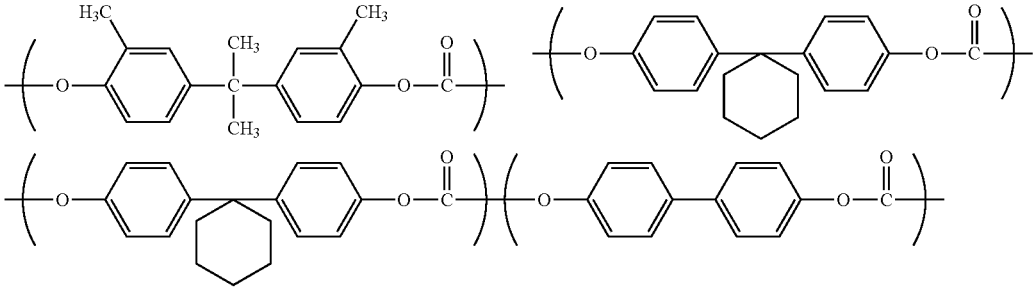

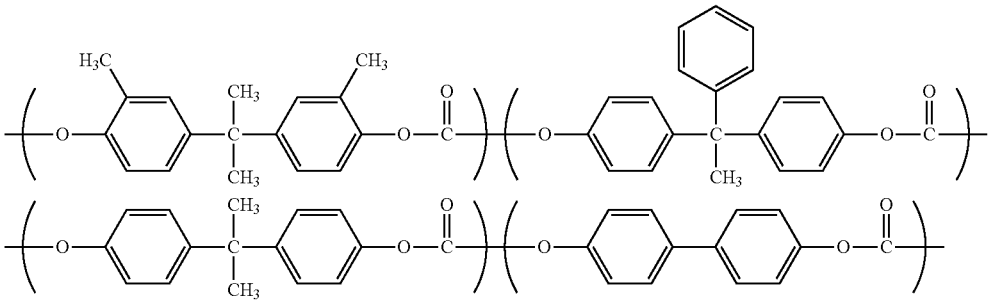

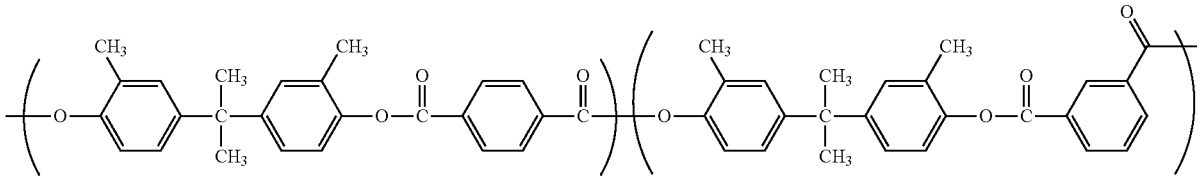

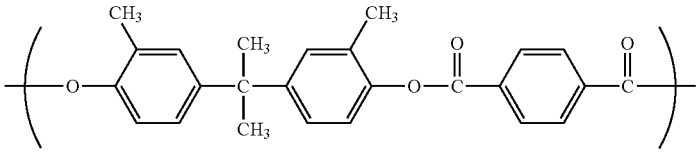

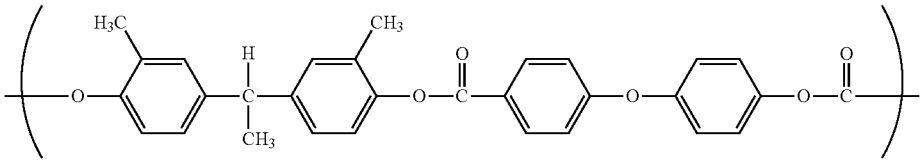

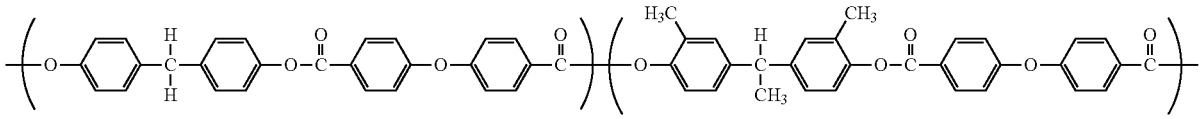

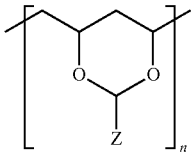

In the structural formula, Z represents a hydrogen atom, an alkyl group, or an aryl group which may have a substituent. Examples of the aryl group include a phenyl group and a naphthyl group. Examples of the alkyl group include a straight-chain alkyl group such as a methyl group, an ethyl group, and a propyl group; a branched alkyl group such as an isopropyl group, a tert-butyl group, and a isobutyl group; a cyclic alkyl group such as a cyclohexyl group and a cyclopentyl group; and a halogenated alkyl group such as a chloromethyl group and a methyl fluoride group. Considering mechanical characteristics and solubility with a coating liquid for forming a photosensitive layer, an alkyl group is preferable. As the alkyl group, a group having 1 to 10 carbon atoms is preferable, a group 1 to 8 carbon atoms is more preferable, and a group having 1 to 4 carbon atoms is further preferable. Among the groups, from a viewpoint of synthesis, a straight-chain alkyl group is preferable, and a methyl group or an ethyl group is more preferable. As a substituent of an aryl group which may have a substituent, an alkyl group, an alkoxy group, and an amino group are exemplified.

Considering dispersibility of phthalocyanine, it is preferable that the polyvinyl acetal resin contains a hydroxyl group. The content of the hydroxyl group is preferably equal to or less than 50 mol %, more preferably equal to or less than 40 mol %, and further preferably equal to or less than 30 mol %.

The number average molecular weight of the polyvinyl acetal resin is preferably equal to or less than 150,000, more preferably equal to or less than 100,000, further preferably equal to or less than 50,000, and particularly preferably equal to or less than 30,000, from a viewpoint of compatibility with the binder resin. From a viewpoint of crystal stability or dispersibility, the number average molecular weight thereof is preferably equal to or more than 3,000, more preferably equal to or more than 5,000, and further preferably equal to or more than 7,000.

Regarding a mixing ratio of the polyvinyl acetal resin and the total charge generating material, 10 parts by mass or more of the polyvinyl acetal resin is preferably contained, and 30 parts by mass or more thereof is more preferably contained, with respect to 100 parts by mass of the total charge generating material, from a viewpoint of crystal stability or dispersibility. From a viewpoint of the electrical characteristics, 400 parts by mass or less of the polyvinyl acetal resin is preferably contained, 300 parts by mass or less thereof is more preferably contained, and 250 parts by mass or less thereof is further preferably contained with respect to 100 parts by mass of the total charge generating material.

1 to 500 parts by mass of the polyvinyl acetal resin is generally contained with respect to 100 parts by mass of the total charge generating material. Regarding a mixing ratio of the polyvinyl acetal resin and the total charge generating material, 10 parts by mass or more of the polyvinyl acetal resin is preferably contained, and 30 parts by mass or more thereof is more preferably contained, with respect to 100 parts by mass of the total charge generating material, from a viewpoint of crystal stability or dispersibility. From a viewpoint of the electrical characteristics, 400 parts by mass or less of the polyvinyl acetal resin is preferably contained, and 200 parts by mass or less thereof is more preferably contained with respect to 100 parts by mass of the total charge generating material.

In a case where the binder resin is a polycarbonate resin or a polyarylate resin, the content of the polyvinyl acetal resin with respect to 100 parts by mass of the binder resin is preferably equal to or more than 0.1 parts by mass, more preferably equal to or more than 0.5 parts by mass, and further preferably equal to or more than 1 part by mass, from a viewpoint of crystal stability or dispersion stability of the charge generating material. From a viewpoint of the electrical characteristics, the content thereof is preferably equal to or less than 50 parts by mass, more preferably equal to or less than 10 parts by mass, and further preferably equal to or less than 5 parts by mass.

[Filler]

The photosensitive layer contains a filler, and thus it is possible to secure dispersion of the charge generating material well. As the filler, metal oxide particles such as silica, alumina, titanium oxide, barium titanate, zinc oxide, lead oxide, and indium oxide are exemplified. Among the substances, from a viewpoint of electrical characteristics at a time of being used as a photosensitive layer of an electrophotographic photoreceptor, silica or alumina is preferable. From a viewpoint of dispersibility, silica is preferable.

The average primary particle diameter of the filler is generally equal to or more than 0.001 μm. From a viewpoint of suppressing aggregation, the average primary particle diameter thereof is preferably equal to or more than 0.003 μm, and more preferably equal to or more than 0.005 μm. The average primary particle diameter thereof is generally equal to or less than 1 μm. From a viewpoint of stability of a coating liquid, the average primary particle diameter thereof is preferably equal to or less than 0.5 μm, and more preferably equal to or less than 0.1 μm. From a viewpoint of dispersibility, the average primary particle diameter of the filler is preferably smaller than the primary average particle diameter of the charge generating material.

The content of the filler is generally equal to or more than 0.5 parts by mass, with respect to 100 parts by mass of the binder resin. From a viewpoint of dispersion stability, the content thereof is preferably equal to or more than 1.0 parts by mass. From a viewpoint of electrical characteristics, the content thereof is generally equal to or less than 15 parts by mass, and preferably equal to or less than 10 parts by mass.

The surface of silica may be subjected to treatment by an inorganic matter such as tin oxide, aluminum oxide, antimony oxide, zirconium oxide, or silicon oxide, or by an organic matter such as stearic acid, polyol, or silicon. In a case where surface treatment is performed, treatment with a silane treatment agent or a silane coupling agent is preferable, and treatment with a silane treatment agent among the above agents is preferable.

Examples of the silane treatment agent and the silane coupling agent [silane treatment agent] include dimethylsilyl [dimethyl dichlorosilane], trimethylsilyl [hexamethyl disilazane], dimethyl polysiloxane [reactive dimethyl silicone oil], dimethylsiloxane, alkylisilyl, methacrylsilyl, alkylsilyl, vinylsilane, styrylsilane, epoxysilane, acrylsilane, isocyanurate silane, mercaptosilane, sulfide silane, and isocyanate silane. Among the agents, from a viewpoint of storage stability of a photosensitive-layer coating liquid, a matter obtained by performing treatment with dimethylsilyl, trimethylsilyl, or dimethylpolysiloxane as the silane treatment agent is more preferable. From a viewpoint of characteristics of an electrophotographic photoreceptor, a matter obtained by performing treatment with dimethylsilyl or trimethylsilyl is more preferable.

The average primary particle diameter [d] of the filler is calculated by using a specific surface area (which is measured by a BET method) and density (true specific gravity) of a substance constituting a particle. The average primary particle diameter [d] thereof is calculated in accordance with the following Expression (I).

$$d=6/\rho s[\rho\text{: density (true specific gravity), } s\text{: specific surface area by a BET method}] \quad (I)$$

For example, in a case of silica particles having a specific surface area of 110 $m^2/g$, which has been measured by a BET method, calculation is performed by using a point that true specific gravity of silicon dioxide which is a component of the silica is 2.2 $g/cm^3$. The average primary particle diameter thereof is 24.8 nm. The average primary particle diameter of the particles, which is calculated by the calculation expression is generally equal to or less than 200. nm. However, from a viewpoint of coating properties when a photosensitive layer is formed, the average primary particle diameter thereof is preferably equal to or less than 100 nm. From a viewpoint of light attenuation characteristics of an electrophotographic photoreceptor, the average primary particle diameter thereof is more preferably equal to or less than 50 nm, and further preferably equal to or less than 40 nm. The average primary particle diameter thereof is generally equal to or more than 1 nm. From a viewpoint of suppressing aggregation, the average primary particle diameter thereof is preferably equal to or more than 3 nm. From a viewpoint of light attenuation characteristics of an electrophotographic photoreceptor, the average primary particle diameter thereof is more preferably equal to or more than 5 nm.

[Other Additives]

Additives may be contained in each of layers constituting a photosensitive layer, in order to improve film forming properties, flexibility, coating properties, stain resistance, gas resistance, light resistance, or the like. Examples of the additives include an oxidant inhibitor such as hindered amine or hindered phenol; a plasticizer such as terphenyl; an ultraviolet absorbing agent; an electron attracting compound such as a cyano compound; a leveling agent such as silicone oil; or a visible-light blocking agent such as an azo compound. In order to reduce friction resistance of the surface of a photoreceptor, to reduce abrasion, and to improve transfer efficiency of a toner from the photoreceptor to a transfer belt and paper, particles or a filler which is formed from a fluorine resin, a silicone resin, or a polyethylene resin can be contained.

[Coating Liquid for Forming Photosensitive Layer]

A coating liquid for forming a photosensitive layer contains the binder resin, the charge generating material, the hole transport material, the electron transport material, and a solvent. In a case where the coating liquid contains oxytitanium phthalocyanine (D type) which shows a strong diffraction peak at a Bragg angle ($2\theta\pm0.2$) of 27.2° in X-ray diffraction by a CuKα ray, as the charge generating material, when the coating liquid is stored under conditions of a temperature of 55° C. and relative humidity of 10%, for 96 hours, a changing rate of the half decay amount E½ in the photoreceptor is equal to or less than 75%. From a viewpoint of production efficiency of the photoreceptor, the changing rate thereof is preferably equal to or less than 50%, more preferably equal to or less than 25%, and further preferably equal to or less than 10%.

In order to satisfy the changing rate, for example, a method in which a coating liquid in which a filler and a polyvinyl acetal resin are contained along with D type oxytitanium phthalocyanine in the coating liquid and the D type oxytitanium phthalocyanine is dispersed in the polyvinyl acetal resin, and a coating liquid which contains other materials are separately prepared, and the prepared coating liquids are mixed is used. The coating liquid is applied onto a conductive support so as to form a photosensitive layer, and thus it is possible to obtain a positive-charging electrophotographic photoreceptor. The coating liquid may be applied onto an undercoat layer on the conductive support or may be applied onto a charge transport layer. The solvent which will be described below can be used.

[Forming Method of Each Layer]

Each layer constituting an undercoat layer and a photoreceptor in the present invention is formed by sequentially repeating a coating and dry process for each layer. The coating and dry process is performed by well-known methods such as dip coating, spray coating, nozzle coating, a bar coater, a roll coater, and blade coating. The above coating with a coating liquid is performed on a support, and the coating liquid is obtained in a manner that substances to be contained in a layer are dissolved or dispersed in a solvent.

A solvent or a dispersion medium to be used when the coating liquid is manufactured is not particularly limited. However, specific examples thereof include alcohols such as methanol, ethanol, propanol, and 2-methoxyethanol; ethers such as tetrahydrofuran, 1,4-dioxane, and dimethoxyethane; esters such as methyl formate and ethyl acetate; ketones such as acetone, methyl ethyl ketone, and cyclohexanone; aromatic hydrocarbons such as benzene, toluene, and xylene; chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene; nitrogen-containing compounds such as n-butylamine, isopropanolamine, diethylamine, triethanolamine, ethylenediamine, and triethylenediamine; and aprotic polar solvents such as acetonitrile, N-methylpyrrolidone, N,N-dimethylformamide, and dimethylsulfoxide. The above substances may be singly used or may be used in a certain combination of two types or more and different types may be used together.

From a viewpoint of dispersibility and storage properties, it is preferable that the solvent used in the photosensitive layer contains tetrahydrofuran. In this case, the content of tetrahydrofuran is generally equal to or more than 10 parts by mass, with respect to 100 parts by mass of the entirety of the solvent. From a viewpoint of dispersibility, the content thereof is preferably equal to or more than 30 parts by mass, and more preferably equal to or more than 70 parts by mass. From a viewpoint of coating properties, the content thereof is preferably equal to or less than 90 parts by mass.

The amount of the used solvent or dispersion medium is not particularly limited. However, considering the purpose of each layer and properties of a selected solvent or dispersion medium, it is preferable that the amount thereof is appropriately adjusted to cause physical properties such as solid concentration or viscosity of the coating liquid to be in a desired range. For example, in a case of a charge transport layer in a single-layer type photoreceptor and a function-separation type photoreceptor, the solid concentration of a coating liquid is set to be in a range of being generally equal to or more than 5 mass %, and preferably equal to or more than 10 mass %, and to be in a range of being generally equal to or less than 40 mass %, and preferably equal to or less than 35 mass %. The viscosity of the coating liquid is set to be in a range of being generally equal to or more than 10 cps and preferably equal to or more than 50 cps, and to be in a range of being generally equal to or less than 500 cps and preferably equal to or less than 400 cps.

In a case of the charge generation layer in a laminate type photoreceptor, the solid concentration of a coating liquid is set to be in a range of being generally equal to or more than 0.1 mass %, and preferably equal to or more than 1 mass %, and to be in a range of being generally equal to or less than 15 mass %, and preferably equal to or less than 10 mass %. The viscosity of the coating liquid is set to be in a range of being generally equal to or more than 0.01 cps and preferably equal to or more than 0.1 cps, and to be in a range of being generally equal to or less than 20 cps and preferably equal to or less than 10 cps.

As a coating method with a coating liquid, for example, a dip coating method, a spray coating method, a spinner coating method, a bead coating method, a wire-bar coating method, a blade coating method, a roller coating method, an air-knife coating method, a curtain coating method, and the like are exemplified. Other well-known coating methods may be also used.

<Cartridge, Image Forming Apparatus>

Next, a drum cartridge and an image forming apparatus which use the electrophotographic photoreceptor in the present invention will be described with reference to FIG. 1 illustrating an example of the apparatus.

In FIG. 1, 1 indicates a drum-like photoreceptor. The drum-like photoreceptor is rotated and driven around a shaft at a predetermined peripheral speed in a direction indicated by an arrow. A charging device 2 applies uniform charging of a predetermined positive or negative potential to the surface of the photoreceptor 1 on the rotation process. Then, in an exposure device 3, exposure for forming a latent image is performed by image exposure means. Then, the formed electrostatic latent image is developed with a toner in a developing device 4, and toner developed images are sequentially transferred to recording paper (sheet, medium) P which has been fed from a feeding unit, by a corona transfer device 5. Then, the transfer medium on which an image is transferred is sent to a fixing device 7. The image is fixed and is printed out to the apparatus. The toner remaining after the transfer is removed from the surface of the photoreceptor 1 after the image is transferred, by a cleaning device 6. Erasing by an erasing device is performed, and thus the surface of the photoreceptor 1 is purified in order to form the next image is performed.

When the electrophotographic photoreceptor in the present invention is used, examples of a charger include a corona charger such as a corotron or a scorotron illustrated in FIG. 1, and direct charging means. The direct charging means brings a direct charging member to which a voltage is applied, into contact with the surface of the photoreceptor so as to charge the surface thereof. Examples of the direct charging means include a contact charger such as a charging roller and a charging brush. As the direct charging means, any of a charger with aerial discharge and a charger which perform injection charging without aerial discharge may be used. As a voltage to be applied at a time of charging, only a DC voltage can be used or a voltage obtained by superimposing an alternating current on a direct current can be used. In order to perform uniform charging, a plurality of chargers may be used.

Regarding exposure, for example, a halogen lamp, a fluorescent lamp, a laser (for example, semiconductor and He—Ne), an LED, or an in-photoreceptor exposure type is exemplified. As a digital electrophotographic type, a laser, an LED, an optical shutter array, and the like are preferably used. Regarding a wavelength, monochromatic light having a slightly-short wavelength tendency in a region of 600 to 700 nm can be used in addition to monochromatic light of 780 nm.

As a developing process, for example, a dry developing method or a wet developing method is exemplified. Examples of the dry developing method include cascade developing, one-component insulating toner developing, one-component conductive toner developing, and two-component magnetic brush developing. As a toner, a chemical toner obtained by suspension granulation, suspension polymerization, an emulsion polymerization aggregation method, and the like may be used in addition to a pulverized toner. In particular, in a case of the chemical toner, a toner having a small particle diameter of about 4 to 8 μm may be used. The shape of the toner is approximate to a spherical shape. Thus, a toner having a shape which is out from a potato-like spherical shape may be used. A polymerized toner is excellent in charging uniformity and transferability, and is suitably used for increasing image quality.

Regarding a transfer process, for example, an electrostatic transfer method, a pressure transfer method, and an adhesive transfer method such as corona transfer, roller transfer, or belt transfer are exemplified. Regarding fixing, for example, thermal roller fixing, flash fixing, oven fixing, pressure fixing, IH fixing, belt fixing, and IHF fixing are exemplified. These fixing methods may be singly used or may be used in combination of a plurality of fixing methods.

A cleaning process may be omitted. However, in a case where the cleaning process is used, for example, a brush cleaner, a magnetic brush cleaner, an electrostatic brush cleaner, a magnetic roller cleaner, a blade cleaner, and the like are used.

An erasing process is omitted in many cases. However, in a case where the erasing process is used, for example, a fluorescent lamp, an LED, and the like are used. Regarding intensity, exposing energy which is equal to or more than three times that of exposure light is used in many cases. In addition to the above processes, a process of a pre-exposure process or an auxiliary charging process may be provided.

In the present invention, a configuration in which plural components among the drum-like photoreceptor 1, the charging device 2, the developing device 4, the cleaning device 6, and the like are integrally combined with each other and are configured as a drum cartridge, and the drum cartridge is attachable and detachable to and from the main body of an electrophotographic apparatus such as a copier or a laser beam printer will be made. For example, at least one of the charging device 2, the developing device 4, and the cleaning device 6 may be integrally supported along with the drum-like photoreceptor 1, so as to form a cartridge.

The fixing device 7 is configured from an upper fixing member (fixing roller) 71 and a lower fixing member (fixing roller) 72. A heating device 73 is provided in the fixing member 71 or 72. FIG. 1 illustrates an example in which the heating device 73 is provided in the upper fixing member 71. Each of the upper and lower fixing members 71 and 72 may use well-known thermal fixing members such as a fixing roll in which a metal tube of stainless steel, aluminum, or the like is coated with silicon rubber, a fixing roll in which the metal tube is coated with TEFLON (registered trademark) resin, and a fixing sheet. Further, the fixing members 71 and 72 may have a configuration in which a releasing agent such as silicone oil is supplied in order to improve release properties, or may have a configuration in which a spring and the like causes the fixing members 71 and 72 to forcibly apply pressure to each other.

When a toner transferred onto recording paper P passes through a space between the upper fixing member 71 and the lower fixing member 72 which are heated to a predetermined temperature, the toner is heated until the toner is in a molten state. After passing, the toner is cooled so as to fix the toner onto the recording paper P. The type of the fixing device is not particularly limited. A fixing device by any method, for example, heating roller fixing, flash fixing, oven fixing, or pressure fixing may be provided in addition to the fixing device used here.

In an electrophotographic apparatus configured as described above, recording an image is performed in the following manner. That is, firstly, the surface (photosensitive surface) of the photoreceptor 1 is charged to be a predetermined potential (for example, −600 V), by the charging device 2. At this time, the surface thereof may be charged by a DC voltage or may be charged by a voltage which is obtained by superimposing an AC voltage on a DC voltage.

Then, the charged photosensitive surface of the photoreceptor 1 is exposed by the exposure device 3, in accordance with an image to be recorded. Thus, an electrostatic latent image is formed on the photosensitive surface. The electrostatic latent image formed on the photosensitive surface of the photoreceptor 1 is developed by the developing device 4.

In the developing device 4, a restriction member (developing blade) 45 causes the thickness of a layer formed by the toner T supplied by a supply roller 43, to be thin. In addition, the developing device 4 performs friction charging to have a predetermined polarity. While the toner T is held on a developing roller 44, the toner T is transported, and thus is brought into contact with the surface of the photoreceptor 1.

If the charged toner T which has been held on the developing roller 44 is brought into contact with the surface of the photoreceptor 1, a toner image corresponding to the electrostatic latent image is formed on the photosensitive surface of the photoreceptor 1. The toner image is transferred to recording paper P by the transfer device 5. Then, a toner which is not transferred and but remains on the photosensitive surface of the photoreceptor 1 is removed by the cleaning device 6.

After the toner image is transferred onto the recording paper P, the toner image is caused to pass through the fixing device 7, and is thermally fixed onto the recording paper P. Thus, a final image is obtained.

The image forming apparatus may have a configuration in which, for example, an erasing process is performed, in addition to the above-described configuration. The erasing process is a process in which exposure is performed to an electrophotographic photoreceptor, and thus erasing is performed on the electrophotographic photoreceptor. As an erasing device, a fluorescent lamp, an LED, or the like is used. Regarding intensity of light used in the erasing process, exposing energy which is equal to or more than three times that of exposure light is used in many cases.

The image forming apparatus may be configured by modification. For example, a configuration in which processes of a pre-exposure process, an auxiliary charging process, and the like can be performed, a configuration in which offset printing is performed, and a configuration of a full-color tandem type using plural types of toners may be made.

EXAMPLES

The embodiment will be more specifically described below based on examples. The following examples are just used for describing the present invention in detail, and the present invention it is not limited to the following examples in a range without departing from the gist of the present invention. The description of "a part" in the following examples, comparative examples, and reference examples refers to "a part by mass" as long as a particular statement is not described.

Manufacturing of Coating Liquid for Forming Photosensitive Layer

Example 1S 10 parts by mass of oxytitanium phthalocyanine (below set to be CGM1) were added to 150 parts by mass of 1,2-dimethoxyethane, and grinding dispersion treatment was performed in a sand grinding mill, thereby a pigment dispersion liquid was manufactured. The above oxytitanium phthalocyanine shows strong diffraction peaks at Bragg angles (2θ±0.2) of 9.6°, 24.1°, and 27.2° as illustrated in FIG. 2, in X-ray diffraction by a CuKα ray. 160 parts by mass of the pigment dispersion liquid obtained in this manner were added to 5 weight % of polyvinyl butyral [manufactured by Denka Ltd., product name: #6000C], and 100 parts by mass of a 1,2-dimethoxyethane solution. 1,2-dimethoxyethane of an appropriate amount was added, and finally an undercoat dispersion liquid in which solid concentration was 4.0 weight % was manufactured.

A cylinder was subjected to immersion coating in the undercoat dispersion liquid. The surface of the cylinder was cut, and the cylinder had an outer diameter of 30 mm, a length of 244 mm, and a wall thickness of 0.75 mm. The cylinder was formed by an aluminum alloy. After the immersion coating is performed, an undercoat layer was formed so as to have a film thickness of 0.4 μm after drying.

Then, the oxytitanium phthalocyanine (CGM1) was dispersed along with toluene by a sand grinding mill, thereby a dispersion liquid in which solid concentration was 3.5 mass % was obtained. Then, silica particles [manufactured by Japan Aerosil Corporation (Evonik Resouse Efficiency GmbH), product name: AEROSIL R972, primary particle diameter of 16 nm, specific surface area of 110 $m^2/g$] were dispersed along with tetrahydrofuran, thereby a dispersion liquid in which solid concentration was 4.0 mass % was obtained. Then, a polyvinyl acetal resin [manufactured by Sekisui Chemical Co., Ltd., product name: S-LEC KS-10 (Mn: 20,400, hydroxyl group: 25.3 mol, acetalization degree: 74.1 mol %, and acetyl group: 0.6 mol % or less)] was dissolved in tetrahydrofuran, thereby a dissolution liquid in which solid concentration was 10 mass % was obtained.

A hole transport material represented by the following structural formula (CTM1), an electron transport material represented by the following structural formula (ETM3), and a polycarbonate resin [viscosity-average molecular weight: Mv=39,600] represented by the following structural formula (P-1) were dissolved in a solvent mixture of tetrahydrofuran and toluene. 0.05 parts by mass of the resultant of the dissolving with respect to 100 parts by mass of a binder resin were added as a leveling agent. The oxytitanium phthalocyanine dispersion liquid, the silica particle dispersion liquid, and the polyvinyl acetal resin dissolution liquid were uniformly mixed with each other in the solution obtained in the above manner, by a homogenizer. Thus, a coating liquid for a positive-charging single-layer type photosensitive layer, in which solid concentration was 24% [tetrahydrofuran/toluene=8/2 (mass ratio)] was prepared.

The coating liquid for a positive-charging single-layer type photosensitive layer, which was prepared in this manner was applied onto the above-described undercoat layer, so as to cause a film thickness after drying to be 30 μm. Thus, a positive-charging single-layer type electrophotographic photoreceptor AS [before time-change] was obtained. Table-1 shows the composition ratio of the materials.

The obtained coating liquid for a positive-charging single-layer type photosensitive layer was put into an airtight container so as not to volatilize the solvent in the coating liquid. Then, storing under conditions of a temperature of 55° C. and relative humidity of 10% was performed for 96 hours, so as to perform time-change treatment of the coating liquid for a positive-charging single-layer type photosensitive layer. The same operation as that when the photoreceptor before time-change was manufactured was performed by using the obtained coating liquid after time-change. Thus, a positive-charging single-layer type electrophotographic photoreceptor AS [after time-change] having a photosensitive layer which had a film thickness of 30 μm was obtained.

Formula (CTM1)

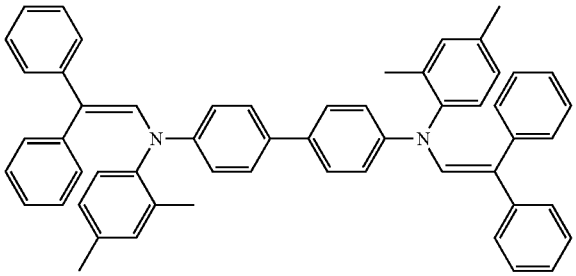

E_homo = -4.60 (eV)

Formula (ETM3)

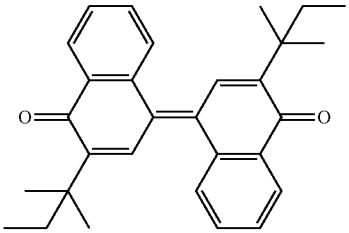

Formula (P-1)

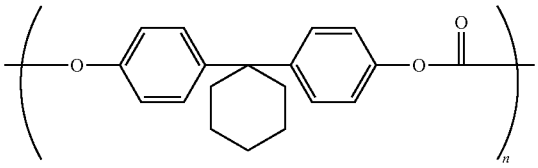

Examples 2S and 3S

A coating liquid for a positive-charging single-layer type photosensitive layer was prepared at the composition ratio shown in Table-1, by using materials similar to those in Example 1S, thereby positive-charging single-layer type photoreceptors BS and CS having a film thickness of 30 μm were obtained.

Example 4S

A coating liquid for a positive-charging single-layer type photosensitive layer was prepared at the composition ratio shown in Table-1, by performing an operation similar to that in Example 1S except that the polyvinyl acetal resin used in Example 1S was changed to a different polyvinyl acetal resin [manufactured by Kuraray Corporation, product name: Mowital B 14S (Mn: about 11,400, hydroxyl group: about 23.6 mol %, acetalization degree: 71.4 mol %, and acetyl group: 5.0 mol %)]. Thus, a positive-charging single-layer type photoreceptor DS having a film thickness of 30 μm was obtained.

Examples 5S and 6S

A coating liquid for a positive-charging single-layer type photosensitive layer was prepared at the composition ratio shown in Table-1, by performing an operation similar to that in Example 4S except that 10 parts of an aromatic compound as an additive were added to the material used in Example 4S. Thus, positive-charging single-layer type photoreceptors ES and FS having a film thickness of 30 μm were obtained.

Example 7S

A coating liquid for a positive-charging single-layer type photosensitive layer was prepared at the composition ratio shown in Table-1, by performing an operation similar to that in Example 4S except that silica particles were not used in the material used in Example 4S. Thus, a positive-charging single-layer type photoreceptor GS having a film thickness of 30 μm was obtained.

Example 8S

A coating liquid for a positive-charging single-layer type photosensitive layer was prepared at the composition ratio shown in Table-1, by performing an operation similar to that in Example 4S except that the silica particles used in Example 4S were changed to different silica particles [manufactured by Japan Aerosil Corporation (Evonik Resouse Efficiency GmbH), product name: AEROSIL RY200, primary particle diameter of 16 nm, specific surface area of 100 $m^2/g$]. Thus, a positive-charging single-layer type photoreceptor HS having a film thickness of 30 μm was obtained.

Example 9S

A coating liquid for a positive-charging single-layer type photosensitive layer was prepared at the composition ratio shown in Table-1, by performing an operation similar to that in Example 4S except that the silica particles used in Example 4S were changed to different silica particles [manufactured by Evonik Corporation, product name: AEROSIL RX300, primary particle diameter of 7 nm, specific surface area of 210 $m^2/g$]. Thus, a positive-charging single-layer type photoreceptor IS having a film thickness of 30 μm was obtained.

Example 10S

A coating liquid for a positive-charging single-layer type photosensitive layer was prepared at the composition ratio shown in Table-1, by performing an operation similar to that in Example 6S except that 10 parts of an aromatic compound as an additive were added to the material used in Example 4S, and the hole transport material was changed to a hole transport material represented by the following structural formula (CTM2). Thus, a positive-charging single-layer type photoreceptor JS having a film thickness of 30 μm was obtained.

Formula (CTM2)

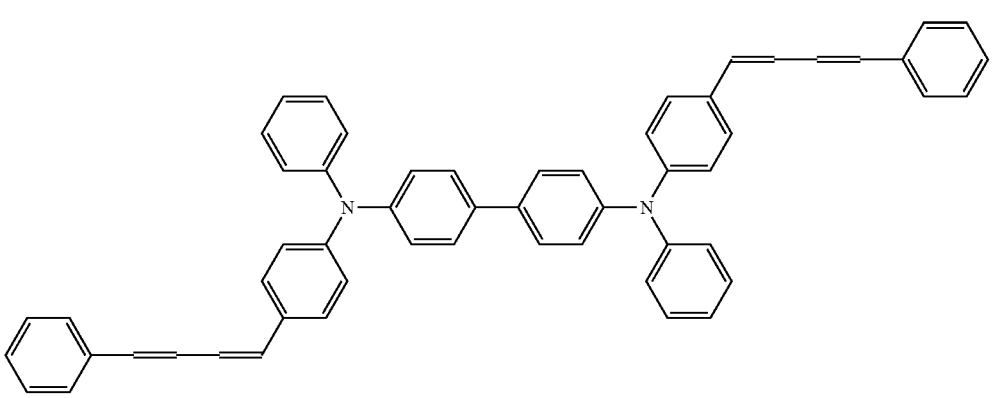

E_homo = -4.65 (eV)

Example 11S

A coating liquid for a positive-charging single-layer type photosensitive layer was prepared at the composition ratio shown in Table-1, by performing an operation similar to that in Example 6S except that the hole transport material used in Example 6S was changed to a hole transport material represented by the following structural formula (CTM3). Thus, a positive-charging single-layer type photoreceptor KS having a film thickness of 30 μm was obtained.

Example 12S

A coating liquid for a positive-charging single-layer type photosensitive layer was prepared at the composition ratio shown in Table-1, by performing an operation similar to that in Example 6S except that the hole transport material used in Example 6S was changed to a hole transport material represented by the following structural formula (CTM4). Thus, a positive-charging single-layer type photoreceptor LS having a film thickness of 30 μM was obtained.

Formula (CTM3)

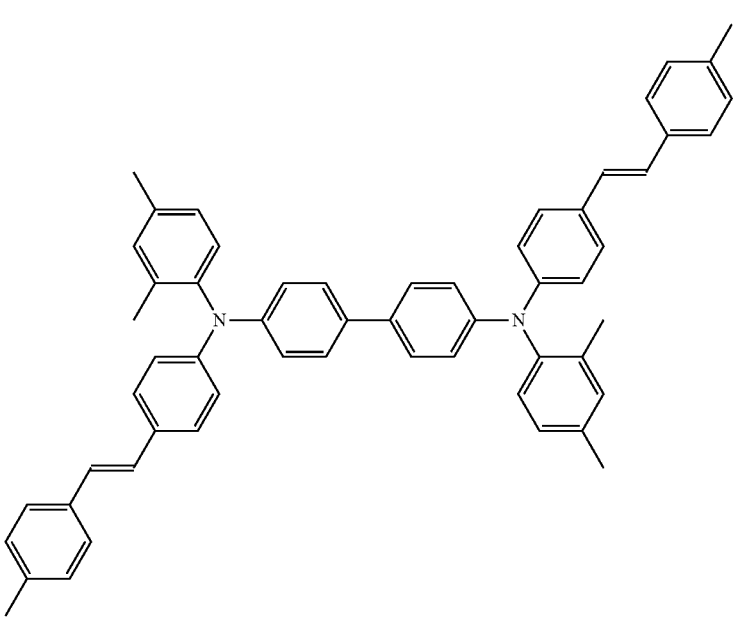

E_homo = -4.58 (eV)

Formula (CTM4)

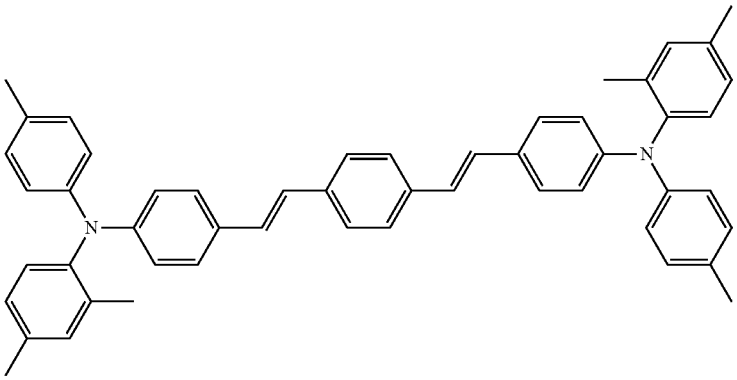

E_homo = -4.48 (eV)

Example 13S

A coating liquid for a positive-charging single-layer type photosensitive layer was prepared at the composition ratio shown in Table-1, by performing an operation similar to that in Example 6S except that the hole transport material used in Example 6S was changed to a hole transport material represented by the following structural formula (CTM5). Thus, a positive-charging single-layer type photoreceptor MS having a film thickness of 30 was obtained.

Formula (CTM5)

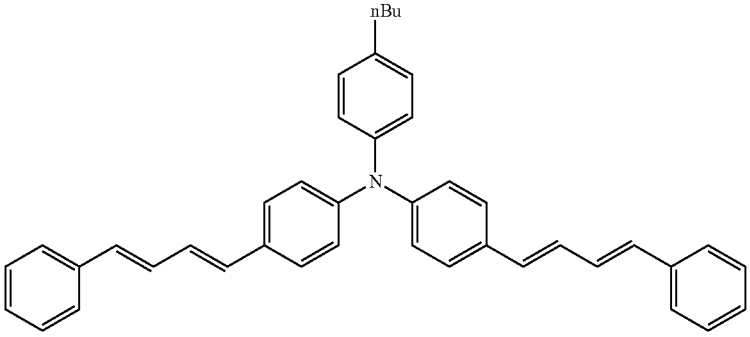

E_homo = -4.63 (eV)

Example 14S

A coating liquid for a positive-charging single-layer type photosensitive layer was prepared at the composition ratio shown in Table-1, by performing an operation similar to that in Example 11S except that the binder resin used in Example 11S was changed to a polycarbonate resin [viscosity-average molecular weight: Mv=40,200, o/p of 84.3/15.7 (molar ratio)] represented by the following structural formula (P-2). Thus, a positive-charging single-layer type photoreceptor NS having a film thickness of 30 μm was obtained.

Formula (P-2)

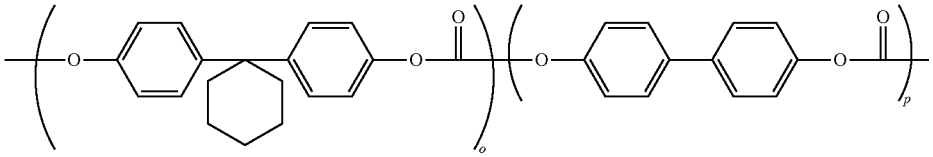

Example 15S

A coating liquid for a positive-charging single-layer type photosensitive layer was prepared at the composition ratio shown in Table-1, by performing an operation similar to that in Example 11S except that the binder resin used in Example 11S was changed to a polycarbonate resin [viscosity-average molecular weight: Mv=40,700, q/r of 49/51 (molar ratio)] represented by the following structural formula (P-3). Thus, a positive-charging single-layer type photoreceptor OS having a film thickness of 30 μm was obtained.

Formula (P-3)

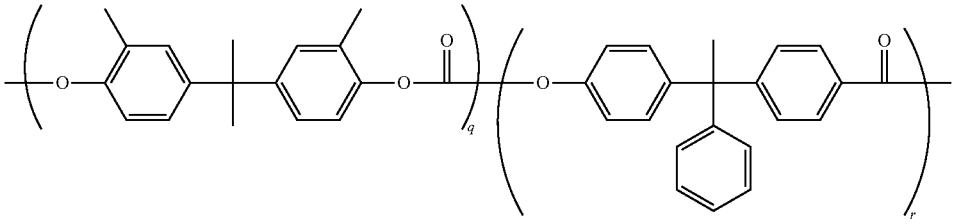

Example 16S

A coating liquid for a positive-charging single-layer type photosensitive layer was prepared at the composition ratio shown in Table-1, by performing an operation similar to that in Example 14S except that the electron transport material used in Example 14S was changed to a mixture of electron transport materials represented by Formula (ETM3) and the following structural formula (ETMS). Thus, a positive-charging single-layer type photoreceptor PS having a film thickness of 30 μm was obtained.

Formula (ETM5)

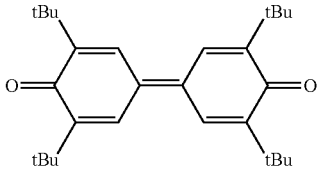

Comparative Example 1S

A coating liquid for a positive-charging single-layer type photosensitive layer was prepared at the composition ratio shown in Table-1, by performing an operation similar to that in Example 1S except that the polyvinyl acetal resin and the silica particles used in Example 1S were not used. Thus, a positive-charging single-layer type photoreceptor RA having a film thickness of 30 μm was obtained.

Comparative Example 2S

A coating liquid for a positive-charging single-layer type photosensitive layer was prepared at the composition ratio shown in Table-1, by performing an operation similar to that in Example 1S except that the polyvinyl acetal resin and the silica particles used in Example 1S were not used, and 10 parts of an aromatic compound were additionally used as an additive. Thus, a positive-charging single-layer type photoreceptor RB having a film thickness of 30 μm was obtained.

TABLE 1

| No. | Photo-receptor | Charge generating material (parts by mass) | Hole transport material (parts by mass) | Electron transport material (parts by mass) | Binder resin (parts by mass) | Butyral resin (parts by mass) | Silica particle (parts by mass) |
|---|---|---|---|---|---|---|---|
| Example 1S | AS | CGM-1 (4.5) | HTM-1 (70) | ETM-1 (40) | P-1 (100) | KS-10 (4.5) | R972 (4.5) |
| Example 2S | BS | CGM-1 (4.5) | HTM-1 (70) | ETM-1 (40) | P-1 (100) | KS-10 (4.5) | R972 (9.0) |
| Example 3S | CS | CGM-1 (4.5) | HTM-1 (70) | ETM-1 (40) | P-1 (100) | KS-10 (4.5) | None (0) |
| Example 4S | DS | CGM-1 (4.5) | HTM-1 (70) | ETM-1 (40) | P-1 (100) | B 14S (4.5) | R972 (4.5) |
| Example 5S | ES | CGM-1 (3.5) | HTM-1 (70) | ETM-1 (40) | P-1 (100) | B 14S (2.25) | R972 (3.5) |
| Example 6S | FS | CGM-1 (2.5) | HTM-1 (70) | ETM-1 (40) | P-1 (100) | B 14S (2.5) | R972 (2.5) |
| Example 7S | GS | CGM-1 (4.5) | HTM-1 (70) | ETM-1 (40) | P-1 (100) | B 14S (2.5) | None (0) |
| Example 8S | HS | CGM-1 (4.5) | HTE-1 (70) | ETM-1 (40) | P-1 (100) | B 14S (4.5) | RY200 (4.5) |

TABLE 1-continued

| No. | Photo-receptor | Charge generating material (parts by mass) | Hole transport material (parts by mass) | Electron transport material (parts by mass) | Binder resin (parts by mass) | Butyral resin (parts by mass) | Silica particle (parts by mass) |
|---|---|---|---|---|---|---|---|
| Example 9S | IS | CGM-1 (4.5) | HTM-1 (70) | ETM-1 (40) | P-1 (100) | B 14S (4.5) | RX300 (4.5) |
| Example 10S | JS | CGM-1 (2.5) | HTM-2 (70) | ETM-1 (40) | P-1 (100) | B 14S (2.5) | R972 (2.5) |
| Example 11S | KS | CGM-1 (2.5) | HTM-3 (70) | ETM-1 (40) | P-1 (100) | B 14S (2.5) | R972 (2.5) |
| Example 12S | LS | CGM-1 (2.5) | HTM-4 (70) | ETM-1 (40) | P-1 (100) | B 14S (2.5) | R972 (2.5) |
| Example 13S | MS | CGM-1 (2.5) | HTM-5 (70) | ETM-1 (40) | P-1 (100) | B 14S (2.5) | R972 (2.5) |
| Example 14S | NS | CGM-1 (2.5) | HTM-3 (70) | ETM-1 (40) | P-2 (100) | B 14S (2.5) | R972 (2.5) |
| Example 15S | OS | CGM-1 (2.5) | HTM-3 (70) | ETM-1 (40) | P-3 (100) | B 14S (2.5) | R972 (2.5) |
| Example 16S | PS | CGM-1 (2.5) | HTM-3 (70) | ETM-1 (32) ETM-2 (8) | P-2 (100) | B 14S (2.5) | R972 (2.5) |
| Comparative Example 1S | RA | CGM-1 (4.5) | HTM-1 (70) | ETM-1 (40) | P-1 (100) | None (0) | None (0) |
| Comparative Example 2S | RB | CGM-1 (4.5) | HTM-1 (70) | ETM-1 (40) | P-1 (100) | None (0) | None (0) |

<Electrical Characteristic Test>

The photoreceptor drum was rotated at the constant number of rotations of 100 rpm, and an electrical characteristic evaluation test was performed for a cycle of charging, exposure, potential measurement, and erasing. The test was performed by using an electrophotographic characteristic evaluation apparatus (edited by the association of Electrophotography, "Continuing Foundation and application of electronic photography" published at 1996 by Corona Publishing Co., Ltd., pp. 404 and 405) manufactured based on the measurement standard of the association of Electrophotography. At this time, under conditions of a temperature of 25° C. and humidity of 50%, charging was performed so as to cause an initial surface potential of the photoreceptor to be +700 V, exposure was performed by using light which was obtained as monochromatic light of 780 nm from light of a halogen lamp in an interference filter, and irradiation energy (half exposure energy) when the surface potential was +350 V was measured as the half decay amount E½ (unit: μJ/cm$^2$). The photoreceptor manufactured by using the coating liquid just after the liquid in each of the examples was prepared, and the photoreceptor manufactured by using the coating liquid after time-change treatment [storing at a temperature of 55° C. and relative humidity of 10% for 96 hours] was performed were measured. Durability for the coating liquid which was changed with time was evaluated in a manner that calculation was performed in the following Expression (B) by using the values of the half decay amount E½ respectively obtained by the above measurement. Table-2 shows results.

$$\text{Half decay amount changing rate (\%)} = ([E\tfrac{1}{2}\text{ (after time-change)}]/[E\tfrac{1}{2}\text{(before time-change)}]-1)*100 \qquad \text{Expression (B)}$$

TABLE 2

| Photoreceptor | Half decay amount E½ (μJ/cm$^2$) Before time-change | After time-change | Half decay amount changing rate [%] |
|---|---|---|---|
| AS | 0.112 | 0.130 | 16.1% |
| BS | 0.108 | 0.128 | 18.5% |

TABLE 2-continued

| Photoreceptor | Half decay amount E½ (μJ/cm$^2$) Before time-change | After time-change | Half decay amount changing rate [%] |
|---|---|---|---|
| CS | 0.132 | 0.162 | 22.7% |
| DS | 0.122 | 0.125 | 2.5% |
| ES | 0.132 | 0.139 | 5.3% |
| FS | 0.150 | 0.155 | 3.3% |
| GS | 0.138 | 0.155 | 12.3% |
| HS | 0.118 | 0.120 | 1.7% |
| IS | 0.121 | 0.124 | 2.5% |
| JS | 0.153 | 0.157 | 2.6% |
| KS | 0.148 | 0.152 | 2.7% |
| LS | 0.154 | 0.160 | 3.9% |
| MS | 0.158 | 0.165 | 4.4% |
| NS | 0.156 | 0.161 | 3.2% |
| OS | 0.158 | 0.164 | 3.8% |
| PS | 0.164 | 0.172 | 4.9% |
| RA | 0.139 | 0.255 | 83.5% |
| RB | 0.142 | 0.262 | 84.5% |

Manufacturing of Photoreceptor Drum

Example 1

CGM1 was added to 1,2-dimethoxyethane, and dispersion treatment was performed in a sand grinding mill. Thus, a pigment dispersion liquid was manufactured. The pigment dispersion liquid obtained in this manner was added to a 1,2-dimethoxyethane solution of polyvinyl butyral [manufactured by Denka Ltd., product name of DK-031], thereby a dispersion liquid in which solid concentration was 4.0% was manufactured. The dispersion liquid was immersed and applied on a cylinder which had an outer diameter of 30 mm, a length of 244 mm, and a wall thickness of 0.75 mm, and was formed by an aluminum alloy, so as to cause the film thickness after drying to be 0.4 μm. Then, drying was performed, thereby an undercoat layer was formed.

Then, the oxytitanium phthalocyanine (CGM1) was dispersed along with toluene by a sand grinding mill, thereby a dispersion liquid in which solid concentration was 3.5 mass % was obtained. Then, AEROSIL R972 which is the name of a product manufactured by Japan Aerosil Corporation (Evonik Resouse Efficiency GmbH) was dispersed along with tetrahydrofuran, thereby a dispersion liquid in which solid concentration was 4 mass % was obtained.

The hole transport material (CTM1), the electron transport material (ETM1), the electron transport material (ETM2), and the binder resin (P-1) were dissolved in a solvent mixture of tetrahydrofuran and toluene. 0.05 parts by mass of silicone oil were added as the leveling agent, with respect to 100 parts by mass of the binder resin. Thus, the two types of dispersion liquids were uniformly mixed with each other in the resultant of addition, by a homogenizer. Thus, a coating liquid in which solid concentration was 24 mass % was obtained. The coating liquid prepared in this manner was subjected to immersion coating on the above-described undercoat layer, so as to cause the film thickness after drying to be 25 μm. Thus, a photosensitive layer was formed, and a single-layer type photoreceptor A was obtained. Table-3 shows the composition ratio of the materials.

Hole transport material (CTM6)

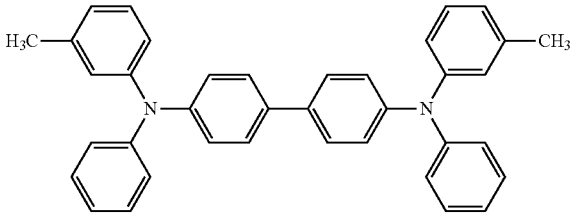

Hole transport material (CTM7)

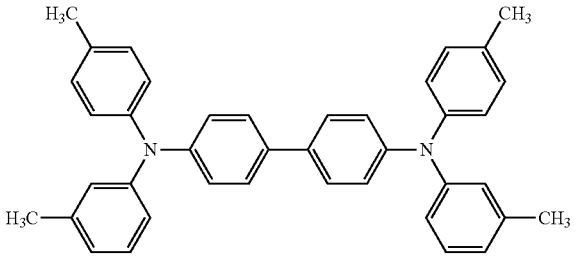

Electron transport material (ETM1)

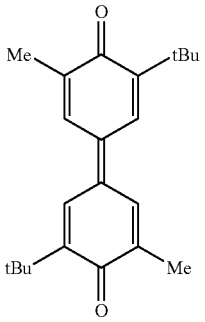

-continued

Electron transport material (ETM2)

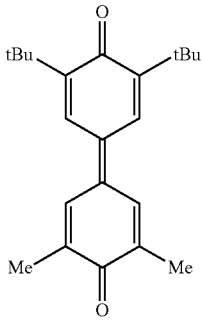

Electron transport material (ETM4)

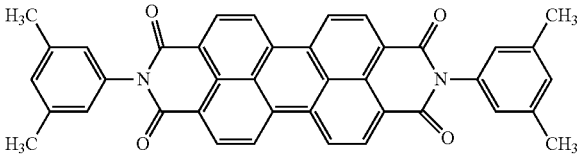

Example 2

The oxytitanium phthalocyanine (CGM1) described in Example 1 was dispersed along with toluene by a sand grinding mill, thereby a dispersion liquid in which solid concentration was 3.5 mass % was obtained. Then, AEROSIL R972 which is the name of a product manufactured by Japan Aerosil Corporation (Evonik Resouse Efficiency GmbH) was dispersed along with tetrahydrofuran, thereby a dispersion liquid in which solid concentration was 4 mass % was obtained. Then, S-LEC KS-10 which is the name of a product manufactured by Sekisui Chemical Co., Ltd. was dissolved in tetrahydrofuran, thereby a dissolution liquid in which solid concentration was 10 mass % was obtained.

The hole transport material (CTM1) having the following structure, the electron transport material (ETM3), and the binder resin (Z) having the following structure as a repetitive unit were dissolved in a solvent mixture of tetrahydrofuran and toluene. 0.05 parts by mass of silicone oil were added as the leveling agent, with respect to 100 parts by mass of the binder resin. Thus, the two types of dispersion liquids and the one type of dissolution liquid were uniformly mixed with each other in the resultant of addition, by a homogenizer. Thus, a coating liquid in which solid concentration was 24 mass % was obtained. The coating liquid prepared in this manner was subjected to immersion coating on an undercoat layer which was similar to that in Example 1, so as to cause the film thickness after drying to be 25 μm. Thus, a photosensitive layer was formed, and a single-layer type photoreceptor B was obtained. Table-3 shows the composition ratio of the materials.

Example 3

A single-layer type photoreceptor C was obtained by performing at a composition similar to that in Example 2, in a manner similar to that in Example 2, except that the film thickness was set to 35 μm.

Example 4

A coating liquid was manufactured at the composition ratio shown in Table-3, by using a method which was similar to that in Example 2, and by using the materials shown in Table-3. Thus, a single-layer type photoreceptor D having a film thickness of 25 μm was obtained.

Example 5

A single-layer type photoreceptor E was obtained by performing at a composition similar to that in Example 4, in a manner similar to that in Example 4, except that the film thickness was set to 35 μm.

Example 6

A coating liquid was prepared at the composition ratio shown in Table-3, by using a method which was similar to that in Example 2 and by using materials which were similar to those in Example 2, except that AEROSIL RX300 which is the name of a product manufactured by Evonik Corporation was used instead of AEROSIL R972 which is the name of a product manufactured by Japan Aerosil Corporation (Evonik Resouse Efficiency GmbH) in Example 2. Thus, a single-layer type photoreceptor F having a film thickness of 25 μm was obtained.

Example 7

A single-layer type photoreceptor G was obtained by performing at a composition similar to that in Example 6, in a manner similar to that in Example 6, except that the film thickness was set to 35 μm.

Example 8

A coating liquid was manufactured at the composition ratio shown in Table-3, by using a method which was similar to that in Example 2, and by using the materials shown in Table-3. Thus, a single-layer type photoreceptor H having a film thickness of 25 μm was obtained.

Example 9

A single-layer type photoreceptor I was obtained by performing at a composition similar to that in Example 8, in a manner similar to that in Example 8, except that the film thickness was set to 35 μm.

Example 10

A coating liquid was manufactured at the composition ratio shown in Table-3, by using a method which was similar to that in Example 2, and by using the materials shown in Table-3. Thus, a single-layer type photoreceptor J having a film thickness of 25 μm was obtained.

Example 11

A coating liquid was manufactured at the composition ratio shown in Table-3, by using a method which was similar to that in Example 2, and by using the materials shown in Table-3. Thus, a single-layer type photoreceptor K having a film thickness of 35 μm was obtained.

Example 12

A coating liquid was manufactured at the composition ratio shown in Table-3, by using a method which was similar to that in Example 2, and by using the materials shown in Table-3. Thus, a single-layer type photoreceptor R having a film thickness of 25 μm was obtained.

Example 13

A coating liquid was manufactured at the composition ratio shown in Table-3, by using a method which was similar to that in Example 2, and by using the materials shown in Table-3. Thus, a single-layer type photoreceptor S having a film thickness of 25 μm was obtained.

Example 14

A coating liquid was manufactured at the composition ratio shown in Table-3, by using a method which was similar to that in Example 2, and by using the materials shown in Table-3. Thus, a single-layer type photoreceptor T having a film thickness of 25 μm was obtained.

Comparative Example 1

The oxytitanium phthalocyanine (CGM1) described in Example 1 was dispersed along with toluene by a sand grinding mill, thereby a dispersion liquid in which solid concentration was 3.5 mass % was obtained.

The hole transport material (CTM6) and hole transport material (CTM7) having the above structures, the electron transport material (ETM4), and the binder resin (Z) having the above structure as a repetitive unit were dissolved in toluene. 0.05 parts by mass of silicone oil were added as the leveling agent, with respect to 100 parts by mass of the binder resin. Thus, the dispersion liquids were uniformly mixed with each other in the resultant of addition, by a homogenizer. Thus, a coating liquid in which solid concentration was 24 mass % was obtained. The coating liquid prepared in this manner was subjected to immersion coating on an undercoat layer which was similar to that in Example 1, so as to cause the film thickness after drying to be 25 μm. Thus, a photosensitive layer was formed, and a single-layer type photoreceptor L was obtained. Table-3 shows the composition ratio of the materials.

Comparative Example 2

A single-layer type photoreceptor M was obtained in a manner similar to that in Example 2 except that AEROSIL R972 which is the name of a product manufactured by Japan Aerosil Corporation (Evonik Resouse Efficiency GmbH) was excluded from Example 2.

Comparative Example 3

Oxytitanium phthalocyanine (below set to be CGM2) was dispersed along with toluene by a sand grinding mill, thereby a dispersion liquid in which solid concentration was 3.5 mass % was manufactured. The above oxytitanium phthalocyanine shows main diffraction peaks at Bragg angles ($2\theta \pm 0.2$) of 9.2°, 10.5°, and 26.2° in X-ray diffraction by a CuKα ray, and has a powder X-ray diffraction spectrum illustrated in FIG. 3. AEROSIL R972 which is the name of a product manufactured by Japan Aerosil Corporation (Evonik Resouse Efficiency GmbH) was dispersed along with tetrahydrofuran, thereby a dispersion liquid in which solid concentration was 4 mass % was obtained.

The hole transport material (CTM1) having the above structure, the electron transport material (ETM1), the electron transport material (ETM2), and the binder resin (Z)

having the above structure as a repetitive unit were dissolved in a solvent mixture of tetrahydrofuran and toluene. 0.05 parts by mass of silicone oil were added as the leveling agent, with respect to 100 parts by mass of the binder resin. The above dispersion liquids were uniformly mixed with each other in the resultant of addition, by a homogenizer. Thus, a coating liquid in which solid concentration was 24 mass % was obtained. The coating liquid prepared in this manner was subjected to immersion coating on an undercoat layer which was similar to that in Example 1, so as to cause the film thickness after drying to be 25 μm. Thus, a photosensitive layer was formed, and a single-layer type photoreceptor N was obtained. Table-3 shows the composition ratio of the materials.

Comparative Example 4

Manufacturing was performed in a manner similar to that in Comparative Example 1 except for using oxytitanium phthalocyanine (below set to be CGM3) which showed strong diffraction peaks at Bragg angles (2θ±0.2) of 7.5°, 22.5°, 25.3°, and 28.6° in X-ray diffraction by a CuKα ray, and has a powder X-ray diffraction spectrum illustrated in FIG. 4. Thus, a single-layer type photoreceptor O was obtained. Table-3 shows the composition ratio of the materials.

Comparative Example 5

The charge generating material, the hole transport material, the electron transport material, the filler, and the binder resin which were shown in Table-3, and 800 parts by mass of tetrahydrofuran were put into a ball mill (zirconia). Mixing and dispersion treatment was performed for 50 hours, thereby a coating liquid for a photosensitive layer was prepared. The obtained coating liquid was applied onto a conductive substrate by a dip-coating method. Then, treatment was performed at 100° C. for 40 minutes, and tetrahydrofuran was removed by coated film. Thus, a single-layer type photoreceptor U which included a photosensitive layer having a film thickness of 25 μm was obtained.

Reference Example 1

A photoreceptor was extracted from a drum unit DR-51J for a commercial laser printer JUSTIO PRO HL-6180DW, which was manufactured by Brother Corporation. The extracted photoreceptor was set to be P.

Reference Example 2

A photoreceptor was extracted from a drum unit DR-22J for a commercial laser printer JUSTIO PRO HL-2270DW, which was manufactured by Brother Corporation. The extracted photoreceptor was set to be Q.

Regarding the manufactured photoreceptors A to Q, the following electrical characteristic test and the following image evaluation test were performed, and results obtained by the tests were collectively shown in Table-4 to Table-8.

<Electrical Characteristic Test>

The photoreceptor drum was rotated at the constant number of rotations of 100 rpm, and an electrical characteristic evaluation test was performed for a cycle of charging, exposure, potential measurement, and erasing (dynamic method). The test was performed by using an electrophotographic characteristic evaluation apparatus (edited by the association of Electrophotography, "Continuing Foundation and application of electronic photography" published at 1996 by Corona Publishing Co., Ltd., pp. 404 and 405) manufactured based on the measurement standard of the association of Electrophotography. Exposure was performed by using light which was obtained as monochromatic light of 780 nm from light of a halogen lamp in an interference filter. The surface potential after exposure having an exposure amount of 0.3 μJ/cm$^2$ was set to be $VL_1$. The surface potential after exposure having an exposure amount of 0.5 μJ/cm$^2$ was set to be $VL_2$. The surface potential after exposure having an exposure amount of 0.8 μJ/cm$^2$ was set to be $VL_3$. The surface potential after exposure having an exposure amount of 1.0 μJ/cm$^2$ was set to be $VL_4$. The surface potential after exposure having an exposure amount of 1.5 μJ/cm$^2$ was set to be $VL_5$.

Whether to perform erasing was set in accordance with the condition shown in Table-4. The half decay amount (referred to as E/2 below) and the exposure amount (referred to as E/5 below) attenuated to be ⅕ of the initial surface potential were measured, and a difference between E/2 and E/5 was obtained. When VL was measured, a time to measure a potential from the exposure was set to be 60 ms. The measurement environment was set to be a temperature of 25° C. and relative humidity of 50%. The initial surface potential (referred to as V0 below) of the photoreceptor is set to be +700±20 V, and results obtained by measuring a potential after the exposure are shown in Table-4. Results obtained by setting V0 to be +900±20 V are shown in Table-5, and results obtained by setting V0 to be +500±20 V are shown in Table-6.

The drum was rotated at 150 rpm by using CYNTHIA manufactured by Gen-Tech, Inc., the time to measure a potential from the exposure was set to be 33 ms, and V0 was set to be +600±20 V. The surface potential after exposure having an exposure amount of 0.3 μJ/cm$^2$ was set to be $VL_1$. The surface potential after exposure having an exposure amount of 0.5 μJ/cm$^2$ was set to be $VL_2$. The surface potential after exposure having an exposure amount of 0.8 μJ/cm$^2$ was set to be $VL_3$. The surface potential after exposure having an exposure amount of 1.0 μJ/cm$^2$ was set to be $VL_4$. The surface potential after exposure having an exposure amount of 1.5 μJ/cm$^2$ was set to be $VL_5$. Whether to perform erasing was set in accordance with the condition shown in Table-7.

The half decay amount (referred to as E/2 below) and the exposure amount (referred to as E/5 below) attenuated to be ⅕ of the initial surface potential were measured, and a difference between E/2 and E/5 was obtained. It is shown that peaks in a light attenuation curve become clear as the value of |E/2−E/5| becomes smaller. Table-7 shows results obtained by measuring a potential after the exposure. The surface potential after exposure having an exposure amount of 0.4 μJ/cm$^2$ was set to be $VL_6$. Table-8 shows results measured by the dynamic method.

The potential after the exposure is measured by using CYNTHIA manufactured by Gen-Tech, Inc., under conditions of V0 which is set to be +600±20 V, an exposure light wavelength of 780 nm, irradiation time of 100 ms, and the exposure amount of 0.4 μJ/cm$^2$. The measurement is performed by a static method. Table-8 shows results obtained by the measurement.

<Image Evaluation Test>

The single-layer type photoreceptor C was mounted in the drum cartridge (DR-51J) of the commercial laser printer HL-6180DW (manufactured by Brother Corporation). Then, image density by black solid printing and a black spot by white solid printing were confirmed. Regarding the measurement environment, three environments of normal-temperature and normal-humidity (temperature of 25° C. and relative humidity of 50%, referred to as N/N below), low-temperature and low-humidity (temperature of 10° C. and relative humidity of 15%, referred to as L/L below), and high-temperature and high-humidity (temperature of 32° C. and relative humidity of 80%, referred to as H/H below) were provided. Table-9 shows results.

TABLE 3

| Example | Photo-receptor | Charge generating material (parts by mass) | Hole transport material (parts by mass) | Electron transport material (parts by mass) | Binder resin (parts by mass) | Polyvinyl acetal | Filler |
|---|---|---|---|---|---|---|---|
| Example 1 | A | CGM1 (4.5) | CTM1 (70) | ETM1/ETM2 (20/10) | Z (100) | None | R972 (4.5) |
| Example 2 | B | CGM1 | CTM1 | ETM3 | Z | KS10 | R972 |
| Example 3 | C | (5) | (60) | (60) | (100) | (2.5) | (5) |
| Example 4 | D | CGM1 | CTM1 | ETM3 | Z | KS10 | R972 |
| Example 5 | E | (5) | (60) | (60) | (100) | (2.5) | (2.5) |
| Example 6 | F | CGM1 | CTM1 | ETM3 | Z | KS10 | RX300 |
| Example 7 | G | (5) | (60) | (60) | (100) | (2.5) | (1.5) |
| Example 8 | H | CGM1 | CTM1 | ETM3 | Z | KS10 | R972 |
| Example 9 | I | (5) | (70) | (40) | (100) | (2.5) | (2.5) |
| Example 10 | J | CGM1 (4.5) | CTM1 (70) | ETM1/ETM2 (20/10) | Z (100) | KS10 (2.25) | R972 (4.5) |
| Example 11 | K | CGM1 (4.5) | CTM1 (70) | ETM3 (40) | Z (100) | KS10 (2.25) | R972 (4.5) |
| Example 12 | R | CGM1 (4.5) | CTM4 (70) | ETM3 (40) | Z (100) | KS10 (2.25) | R972 (4.5) |
| Example 13 | S | CGM1 (4.5) | CTM5 (70) | ETM3 (40) | Z (100) | KS10 (2.25) | R972 (4.5) |
| Example 14 | T | CGM1 (4.5) | CTM3 (70) | ETM3 (40) | Z (100) | KS10 (2.25) | R972 (4.5) |
| Comparative Example 1 | L | CGM1 (3) | CTM2/CTM3 (60/20) | ETM4 (7) | Z (100) | None | None |
| Comparative Example 2 | M | CGM1 (5) | CTM1 (60) | ETM3 (60) | Z (100) | KS10 (2.5) | None |
| Comparative Example 3 | N | CGM2 (4.5) | CTM1 (70) | ETM1/ETM2 (20/10) | Z (100) | None | R972 (2.25) |
| Comparative Example 4 | O | CGM3 (4.5) | CTM3 (70) | ETM1/ETM2 (20/10) | Z (100) | None | R972 (2.25) |
| Comparative Example 5 | U | CGM1 (2) | CTM3 (50) | ETM3 (50) | Z (100) | None | RX200 (5) |

TABLE 4

| Example | Photoreceptor | Erasing | Potential after exposure (V) | | | | | |
|---|---|---|---|---|---|---|---|---|
| | | | $VL_1$ | $VL_2$ | $VL_3$ | $VL_4$ | $VL_5$ | \|E/2-E/5\| |
| Example 1 | A | Provision | 138 | 85 | 68 | 58 | 50 | 0.19 |
| Example 2 | B | Provision | 94 | 49 | 34 | 32 | 26 | 0.12 |
| Example 3 | C | Provision | 83 | 51 | 39 | 37 | 31 | 0.10 |
| Example 4 | D | Provision | 111 | 59 | 42 | 38 | 32 | 0.14 |
| Example 5 | E | Provision | 99 | 65 | 52 | 50 | 43 | 0.12 |
| Example 6 | F | Provision | 117 | 62 | 46 | 41 | 33 | 0.15 |
| Example 7 | G | Provision | 101 | 60 | 52 | 50 | 42 | 0.13 |
| Example 8 | H | Provision | 129 | 70 | 53 | 52 | 40 | 0.16 |
| Example 9 | I | Provision | 108 | 65 | 50 | 48 | 40 | 0.13 |
| Example 10 | J | Provision | 111 | 79 | 67 | 60 | 54 | 0.16 |
| Example 11 | K | Provision | 96 | 64 | 46 | 42 | 39 | 0.11 |
| Example 12 | R | Provision | 133 | 71 | 56 | 55 | 43 | 0.14 |
| Example 13 | S | Provision | 182 | 99 | 74 | 72 | 58 | 0.16 |
| Example 14 | T | Provision | 149 | 80 | 60 | 59 | 46 | 0.15 |
| Comparative Example 1 | L | Provision | 227 | 151 | 120 | 113 | 93 | 0.46 |
| Comparative Example 2 | M | Provision | 167 | 123 | 104 | 100 | 87 | 0.28 |
| Comparative Example 3 | N | Provision | 420 | 294 | 207 | 148 | 109 | 0.69 |
| Comparative Example 4 | O | Provision | 199 | 111 | 84 | 69 | 57 | 0.26 |
| Comparative Example 5 | U | Provision | 438 | 387 | 306 | 266 | 225 | 2.17 |
| Reference Example 1 | P | Provision | 192 | 144 | 113 | 105 | 96 | 0.39 |
| Reference Example 2 | Q | Provision | 368 | 251 | 157 | 132 | 104 | 0.61 |
| Example 2 | B | None | 88 | 49 | 35 | 33 | 27 | 0.11 |
| Example 3 | C | None | 83 | 54 | 43 | 40 | 34 | 0.10 |
| Example 4 | D | None | 101 | 56 | 41 | 38 | 32 | 0.14 |
| Example 5 | E | None | 99 | 69 | 56 | 52 | 44 | 0.13 |
| Example 6 | F | None | 106 | 60 | 44 | 39 | 33 | 0.15 |
| Example 7 | G | None | 100 | 68 | 55 | 52 | 44 | 0.13 |
| Example 8 | H | None | 119 | 72 | 52 | 47 | 38 | 0.15 |
| Example 9 | I | None | 101 | 67 | 50 | 46 | 38 | 0.13 |
| Example 11 | K | None | 94 | 65 | 47 | 41 | 37 | 0.12 |
| Comparative Example 1 | L | None | 244 | 224 | 173 | 172 | 134 | 1.28 |

TABLE 4-continued

| Example | Photoreceptor | Erasing | Potential after exposure (V) | | | | | |E/2-E/5| |
|---|---|---|---|---|---|---|---|---|
| | | | $VL_1$ | $VL_2$ | $VL_3$ | $VL_4$ | $VL_5$ | |
| Comparative Example 2 | M | None | 149 | 115 | 98 | 93 | 83 | 0.25 |
| Reference Example 1 | P | None | 203 | 146 | 110 | 97 | 87 | 0.46 |
| Reference Example 2 | Q | None | 347 | 242 | 160 | 131 | 102 | 0.68 |

TABLE 5

| Example | Photoreceptor | Erasing | Potential after exposure (V) | | | | | |E/2-E/5| |
|---|---|---|---|---|---|---|---|---|
| | | | $VL_1$ | $VL_2$ | $VL_3$ | $VL_4$ | $VL_5$ | |
| Example 3 | C | Provision | 122 | 76 | 53 | 48 | 36 | 0.12 |
| Example 5 | E | Provision | 143 | 83 | 58 | 53 | 41 | 0.13 |
| Example 7 | G | Provision | 152 | 86 | 59 | 54 | 41 | 0.14 |
| Example 9 | I | Provision | 145 | 97 | 66 | 62 | 48 | 0.14 |
| Comparative Example 1 | L | Provision | 403 | 318 | 238 | 237 | 164 | 1.30 |
| Reference Example 1 | P | Provision | 294 | 215 | 150 | 137 | 101 | 0.44 |

TABLE 6

| Example | Photoreceptor | Erasing | Potential after exposure (V) | | | | | |E/2-E/5| |
|---|---|---|---|---|---|---|---|---|
| | | | $VL_1$ | $VL_2$ | $VL_3$ | $VL_4$ | $VL_5$ | |
| Example 3 | C | Provision | 63 | 48 | 40 | 39 | 33 | 0.14 |
| Example 5 | E | Provision | 68 | 50 | 43 | 41 | 36 | 0.15 |
| Example 7 | G | Provision | 70 | 50 | 43 | 41 | 36 | 0.16 |
| Example 9 | I | Provision | 59 | 47 | 40 | 39 | 35 | 0.13 |
| Comparative Example 1 | L | Provision | 155 | 136 | 115 | 111 | 88 | 2.17 |
| Reference Example 1 | P | Provision | 136 | 122 | 103 | 94 | 85 | 1.47 |

TABLE 7

| Example | Photoreceptor | Erasing | Potential after exposure (V) | | | | | |E/2-E/5| |
|---|---|---|---|---|---|---|---|---|
| | | | $VL_1$ | $VL_2$ | $VL_3$ | $VL_4$ | $VL_5$ | |
| Example 11 | K | Provision | 85 | 68 | 61 | 57 | 55 | 0.16 |
| Comparative Example 1 | L | Provision | 189 | 144 | 120 | 111 | 102 | — |
| Reference Example 1 | P | Provision | 134 | 107 | 92 | 88 | 83 | 0.52 |
| Reference Example 2 | Q | Provision | 277 | 202 | 157 | 139 | 122 | — |

TABLE 8

| Example | Photoreceptor | Erasing | Potential after exposure (V) $VL_6$ | |
|---|---|---|---|---|
| | | | Dynamic | Static |
| Example 11 | K | Provision | 74 | 43 |
| Comparative Example 1 | L | Provision | 160 | 131 |
| Reference Example 1 | P | Provision | 117 | 83 |
| Reference Example 2 | Q | Provision | 232 | 204 |

TABLE 9

| Example | Photoreceptor | Image characteristics | | | | | |
|---|---|---|---|---|---|---|---|
| | | Image density | | | Black spot (pieces/one round of drum) | | |
| | | N/N | L/L | H/H | N/N | L/L | H/H |
| Example 3 | C | 1.34 | 1.32 | 1.30 | 0 | 0 | 0 |
| Example 4 | D | 1.34 | 1.36 | 1.34 | 0 | 0 | 0 |
| Example 5 | E | 1.33 | 1.25 | 1.31 | 0 | 0 | 0 |
| Example 6 | F | 1.35 | 1.37 | 1.33 | 0 | 0 | 0 |
| Example 7 | I | 1.34 | 1.27 | 1.33 | 0 | 0 | 0 |
| Example 8 | I | 1.35 | 1.38 | 1.29 | 0 | 0 | 0 |
| Example 9 | I | 1.34 | 1.29 | 1.32 | 0 | 0 | 0 |
| Example 11 | K | 1.36 | 1.33 | 1.34 | 0 | 0 | 0 |

TABLE 9-continued

| | | Image characteristics | | | | | |
|---|---|---|---|---|---|---|---|
| | | Image density | | | Black spot (pieces/one round of drum) | | |
| Example | Photoreceptor | N/N | L/L | H/H | N/N | L/L | H/H |
| Comparative Example 1 | L | 1.27 | 0.99 | 1.29 | 0 | 0 | 0 |
| Comparative Example 2 | M | 1.26 | 1.18 | 1.25 | 0 | 0 | 73 |
| Reference Example 1 | P | 1.33 | 1.22 | 1.34 | 0 | 0 | 0 |

With the above results, it was understood that the configuration in the present invention was satisfied, and thus it was possible to obtain an electrophotographic photoreceptor having good electrical characteristics, and an image forming apparatus having good image characteristics.

The present invention is described in detail by using the specific forms. However, it is apparent from the skilled person in the related art that various changes and modifications may be made without departing from the intention and the scope of the present invention. This application is based upon and claims the benefit of priority from Japanese Patent Application No. 2014-228030 filed Nov. 10, 2014, and Japanese Patent Application No. 2015-138952 filed Jul. 10, 2015; the entire contents of which are incorporated herein by reference.

REFERENCE SIGNS LIST

1 PHOTORECEPTOR (ELECTROPHOTOGRAPHIC PHOTORECEPTOR)
2 CHARGING DEVICE (CHARGING ROLLER; CHARGING UNIT)
3 EXPOSURE DEVICE (EXPOSURE UNIT)
4 DEVELOPING DEVICE (DEVELOPING UNIT)
5 TRANSFER DEVICE
6 CLEANING DEVICE (CLEANING UNIT)
7 FIXING DEVICE
41 DEVELOPER TANK
42 AGITATOR
43 FEEDING ROLLER
44 DEVELOPING ROLLER
45 RESTRICTION MEMBER
71 UPPER FIXING MEMBER (PRESSING ROLLER)
72 LOWER FIXING MEMBER (FIXING ROLLER)
73 HEATING DEVICE
T TONER
P RECORDING PAPER (SHEET, MEDIUM)

The invention claimed is:

1. An electrophotographic photoreceptor which is a positive charging type electrophotographic photoreceptor comprising a conductive support and a single-layer type photosensitive layer on the conductive support, wherein the single-layer type photosensitive layer comprises a charge generating material, a hole transport material, an electron transport material, a filler, a polyvinyl acetal resin, and a binder resin other than the polyvinyl acetal resin, in the same layer, and the charge generating material comprises oxytitanium phthalocyanine, which has a main clear peak at a Bragg angle 2θ±0.2° of 27.2° in powder X-ray diffraction using a CuKα characteristic X-ray.

2. The electrophotographic photoreceptor according to claim 1, wherein the polyvinyl acetal resin is a polyvinyl butyral resin.

3. The electrophotographic photoreceptor according to claim 1, wherein the binder resin is a polycarbonate resin or a polyarylate resin, and 0.1 to 50 parts by mass of the polyvinyl acetal resin are included with respect to 100 parts by mass of the binder resin.

4. The electrophotographic photoreceptor according to claim 3, wherein the binder resin is a polycarbonate resin.

5. The electrophotographic photoreceptor according to claim 3, wherein 1 to 10 parts by mass of the polyvinyl acetal resin are included with respect to 100 parts by mass of the binder resin.

6. The electrophotographic photoreceptor according to claim 3, wherein 1 to 5 parts by mass of the polyvinyl acetal resin are included with respect to 100 parts by mass of the binder resin.

7. The electrophotographic photoreceptor according to claim 1, wherein an energy level E_homo of HOMO obtained as a result of structural optimization calculation by density functional calculation B3LYP/6-31G(d, p) of the hole transport material satisfies the following expression:

$$E_homo > -4.65 \text{ (eV)}.$$

8. The electrophotographic photoreceptor according to claim 1, wherein the polyvinyl acetal resin is a polyvinyl butyral resin, and the binder resin is a polycarbonate resin.

9. The electrophotographic photoreceptor according to claim 8, wherein 1 to 10 parts by mass of the polyvinyl butyral resin are included with respect to 100 parts by mass of the polycarbonate resin.

10. The electrophotographic photoreceptor according to claim 8, wherein 1 to 5 parts by mass of the polyvinyl butyral resin are included with respect to 100 parts by mass of the polycarbonate resin.

11. The electrophotographic photoreceptor according to claim 1, wherein 10 to 400 parts by mass of the polyvinyl acetal resin are included with respect to 100 parts by mass of the total charge generating material.

12. A coating liquid, which comprises a polyvinyl acetal resin, a binder resin other than the polyvinyl acetal resin, a charge generating material, a hole transport material, an electron transport material and a solvent, and comprises oxytitanium phthalocyanine which has a strong diffraction peak at a Bragg angle (2θ±0.2) of 27.2° in X-ray diffraction by a CuKα ray, as the charge generating material, wherein when the coating liquid is stored under conditions of a temperature of 55° C. and relative humidity of 10%, for 96 hours, a changing rate of a half decay amount E½ in the photoreceptor is equal to or less than 75%.

13. The coating liquid according to claim 12, wherein the solvent is an organic solvent comprising tetrahydrofuran.

14. The coating liquid according to claim 12, wherein the electron transport material is a compound represented by the following Formula (1):

Formula (1)

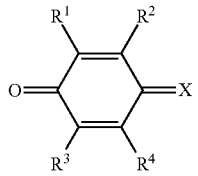

wherein in Formula (1), $R^1$ to $R^4$ each independently represent a hydrogen atom, an alkyl group having 1 to 20 carbon atoms which may have a substituent, or an alkenyl group having 1 to 20 carbon atoms which may have a substituent, and $R^1$ and $R^2$ are bound to each other to form a cyclic structure or $R^3$ and $R^4$ are bound to each other to form a cyclic structure, and X represents an organic residue having a molecular weight of 120 to 250.

* * * * *